US009753403B2

(12) United States Patent
Shirakata et al.

(10) Patent No.: US 9,753,403 B2
(45) Date of Patent: Sep. 5, 2017

(54) IMAGE FORMING APPARATUS FOR EXECUTING DEVELOPER REPLENISHMENT CONTROL

(71) Applicant: CANON KABUSHIKI KAISHA, Tokyo (JP)

(72) Inventors: Jiro Shirakata, Chigasaki (JP); Shusuke Miura, Toride (JP); Kana Oshima, Ako (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/982,277

(22) Filed: Dec. 29, 2015

(65) Prior Publication Data

US 2016/0202635 A1 Jul. 14, 2016

(30) Foreign Application Priority Data

Jan. 8, 2015 (JP) ..... 2015-002595
Jan. 16, 2015 (JP) ..... 2015-007190

(51) Int. Cl.
*G03G 15/08* (2006.01)
*G03G 15/00* (2006.01)

(52) U.S. Cl.
CPC ..... *G03G 15/0877* (2013.01); *G03G 15/0824* (2013.01); *G03G 15/0849* (2013.01);
(Continued)

(58) Field of Classification Search
CPC ..... G03G 15/0877; G03G 15/556; G03G 15/0829; G03G 15/0824; G03G 15/0849; G03G 15/0853; G03G 2215/0888
(Continued)

(56) References Cited

U.S. PATENT DOCUMENTS 5,111,247 A * 5/1992 Nichols ..... G03G 15/0849 366/142
5,839,022 A * 11/1998 Wang ..... G03G 15/0853 399/30
(Continued)

FOREIGN PATENT DOCUMENTS

JP H08-110696 A 4/1996
JP H09-127780 A 5/1997
(Continued)

OTHER PUBLICATIONS

Kana Oshima, et al., U.S. Appl. No. 14/867,420, filed Sep. 28, 2015.

*Primary Examiner* — Robert Beatty
(74) *Attorney, Agent, or Firm* — Fitzpatrick, Cella, Harper & Scinto

(57) ABSTRACT

An image forming apparatus includes a latent image forming unit that forms an electrostatic latent image on an image carrier based on an image signal, a development unit that includes a circulation mechanism that circulates developer in the development unit and develops the electrostatic latent image using the developer, and a detector unit that detects a toner density of the developer in the development unit. A determination unit determines a replenishment amount of toner to the development unit based on the toner density detected by the detector unit, and a replenisher unit replenishes the development unit with toner based on the determined replenishment amount. The determination unit reduces a predetermined ripple that occurs in accordance with a period of circulation of the developer by executing filter processing for reducing the predetermined ripple.

13 Claims, 19 Drawing Sheets

(52) U.S. Cl.
CPC ..... *G03G 15/0893* (2013.01); *G03G 15/556* (2013.01); *G03G 2215/0888* (2013.01)

(58) Field of Classification Search
USPC ..... 399/27, 30, 62, 63, 258
See application file for complete search history.

(56) References Cited

U.S. PATENT DOCUMENTS

| | | | | |
|---|---|---|---|---|
| 7,433,613 | B2 * | 10/2008 | Zollner | G03G 15/0853 399/30 |
| 7,801,453 | B2 * | 9/2010 | Golding | G03G 15/553 399/27 |
| 2008/0273885 | A1 * | 11/2008 | Koizumi | G03G 15/09 399/30 |
| 2016/0202653 | A1 * | 7/2016 | Shirakata | G03G 15/0831 399/27 |

FOREIGN PATENT DOCUMENTS

| | | | | |
|---|---|---|---|---|
| JP | 2000066502 | A | * | 3/2000 |
| JP | 2000105498 | A | * | 4/2000 |
| JP | 2006251547 | A | * | 9/2006 |

* cited by examiner

IMAGE FORMING APPARATUS FOR EXECUTING DEVELOPER REPLENISHMENT CONTROL

BACKGROUND OF THE INVENTION

Field of the Invention

The present invention relates to an image forming apparatus, and in particular relates to replenishment control for maintaining a toner density in a developing unit at a target density.

Description of the Related Art

A developing unit using a two-component developer including a toner and a carrier detects toner density by a sensor to maintain toner density at a target density (Japanese Patent Laid-Open No. H8-110696). When toner is used for an image formation, the toner is replenished from a toner tank to the developing unit, and the toner and the carrier are mixed by a mixer.

In recent years, there is a demand for miniaturization, a reduction in capacity or the like in developing units. If a developing unit is miniaturized, the amount of replenished toner per time increases with respect to the capacity of the developing unit, and there are cases in which the toner and the carrier are not mixed sufficiently. In particular, toner density outputted by a sensor tends to fluctuate immediately after the toner is replenished. This is especially noticeable for a small-scale developing unit. An output value of the sensor repeatedly increases/decreases and finally converges to the actual toner density. Accordingly, when toner is replenished using a toner density obtained by the sensor when toner and carrier are not mixed sufficiently, the toner density ceases to be controlled to the target density.

SUMMARY OF THE INVENTION

The present invention controls replenishment of toner to a developing unit at a higher precision.

The present invention provides an image forming apparatus comprising the following elements. A latent image forming unit is configured to form an electrostatic latent image on an image carrier based on image signal. A development unit that includes a circulation mechanism is configured to circulate developer in a development unit, and that is configured to develop the electrostatic latent image using the developer. A detector unit is configured to detect a toner density of the developer in the development unit. A determination unit is configured to determine a replenishment amount of toner to the development unit based on the toner density detected by the detector unit. A replenisher unit is configured to replenish the development unit with toner based on the replenishment amount determined by the determination unit. The determination unit reduces a ripple that occurs in accordance with a period of circulation of the developer by executing filter processing for reducing the ripple.

Further features of the present invention will become apparent from the following description of exemplary embodiments (with reference to the attached drawings).

DESCRIPTION OF THE EMBODIMENTS

<Image Forming Apparatus>

The present embodiment can be applied to an image forming apparatus for forming an image by an electrophotographic method, an electrostatic recording method, or the like, on an image carrier using for example a photosensitive member, a dielectric or the like. The image forming apparatus forms a latent image corresponding to an image signal on an image carrier, and forms a visible image (toner image) by developing the latent image by a developing apparatus using a two-component developer. Toner particles and carrier particles are principal components of the two-component developer. A visible image is transferred onto a transfer material such as a paper by the image forming apparatus, and is fixed on the transfer material by a fixing unit. Also, the image forming apparatus may be any product such as a printer, a copying machine, a multi function peripheral, or a facsimile machine.

Figure 1:
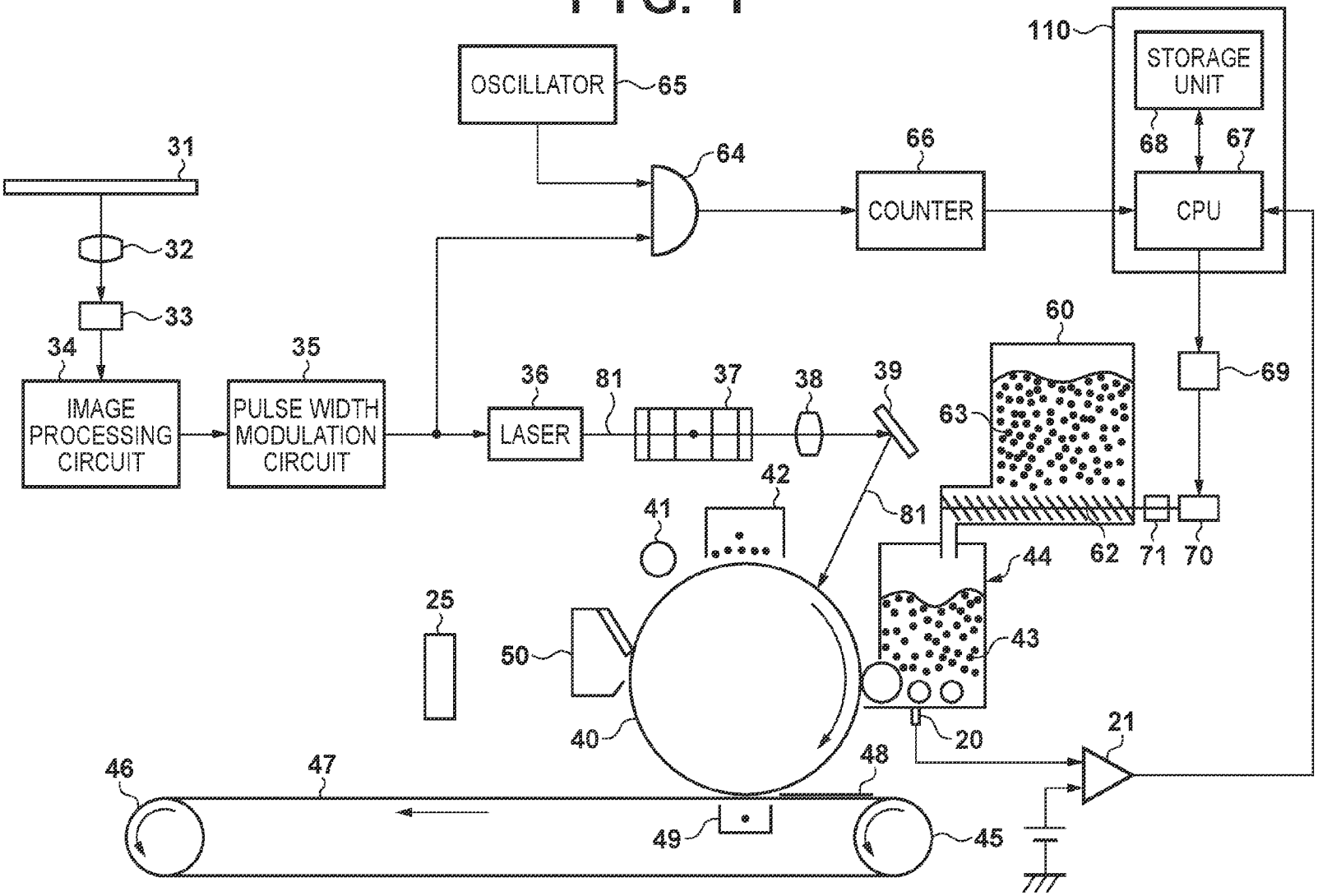
FIG. 1 is a view for illustrating an example of an image forming apparatus.

In FIG. 1, an image of an original 31 to be copied is projected to an image sensor 33 such as CCD (Charge Coupled Device) by a lens 32. The image sensor 33 breaks the image of the original 31 into a large number of pixels, and generates a photoelectric conversion signal corresponding to a density of each pixel. An analog image signal outputted from the image sensor 33 is transmitted to an image processing circuit 34. The image processing circuit 34 converts the analog image signal to a pixel image signal having an output level for each pixel that corresponds to the density of the pixel, and transmits that to a pulse width modulation circuit 35. The pulse width modulation circuit 35 forms and outputs a laser driving pulse for each inputted pixel image signal with a width (duration) corresponding to this level. A driving pulse with a wider width is generated for a high density pixel image signal, and a driving pulse with a narrower width is generated for a low density pixel image signal. A laser driving pulse outputted from the pulse width modulation circuit 35 is supplied to a semiconductor laser 36 which is a latent image forming unit. The semiconductor laser 36 emits only at a time corresponding to the pulse width. Accordingly, the semiconductor laser 36 is driven for a longer time for a high density pixel, and driven for a shorter time for a low density pixel.

A rotational polygonal mirror 37 deflects and scans a laser beam 81 emitted from the semiconductor laser 36. The laser beam 81 is caused to form a spot on a photosensitive drum 40 by a lens 38 such as an f/θ lens and a fixed mirror 39. Then, the laser beam 81 scans on the photosensitive drum 40 in a direction (main scanning direction) substantially parallel to a rotation axis of the photosensitive drum 40, and thereby forms an electrostatic latent image. Note, there are devices that use a light source other than the semiconductor laser 36 in the present embodiment such as an LED array as a latent image forming unit, and the present invention may also be applied to these.

The photosensitive drum 40 is an example of an image carrier. The photosensitive drum 40 comprises a photosensitive layer of for example amorphous silicon, selenium, an OPC, or the like, on its surface, and rotates in an arrow symbol direction. The photosensitive drum 40 charges uniformly by a primary charger 42 after an electric-charge remover 41 removes electric-charge uniformly. After that, exposure scanning is executed by the laser beam 81 modulated in accordance with the image signal. Thereby, an electrostatic latent image corresponding to the image signal is formed. A developing unit 44, which is a development unit, performs a reversal development of an electrostatic latent image using a two-component developer (a developer 43) in which toner particles and carrier particles are mixed, and forms a visible image (toner image). Reversal development is a development method for causing a toner that is charged to the same polarity as the latent image to be attached at a region where the surface of the photosensitive drum 40 is exposed by the laser beam 81, and visualizing that. A transfer charger 49 transfers the toner image to a transfer material 48 held on a carry belt 47. The endless carry belt 47 is stretched between a roller 45 and a roller 46 and driven in an arrow symbol direction. The carry belt 47 may be an intermediate transfer belt. In such a case,the toner image is primary transferred to the intermediate transfer belt, and is secondary transferred to the transfer material 48 from the intermediate transfer belt. The roller 46 and a roller 45 arranged opposite function as a secondary transfer roller pair. An image sensor 25 is an image density detector unit or a reading unit for reading a toner patch formed on the intermediate transfer belt or the transfer material 48, and detecting an image density of the toner patch. The transfer material may also be referred to as a recording material, a recording medium, a paper, a sheet or a transfer sheet. A CPU 67 adjusts the value of a target density in the developing unit 44 so that the image density of the toner patch approaches a target density.

Note, only one image forming station (including the photosensitive drum 40, the electric-charge remover 41, the primary charger 42, the developing unit 44, and the like) is shown graphically in order to simplify the explanation. For a color image forming apparatus, for example 4 image forming stations corresponding to each color of cyan, magenta, yellow and black are arranged sequentially on the carry belt 47 in its movement direction. Electrostatic latent images for each color, for which a color decomposition of an image of an original is performed, are formed sequentially on the photosensitive drums of each image forming station, are developed by the developing units comprising a toner of each corresponding color, and are sequentially transferred to the transfer material 48 held and conveyed by the carry belt 47. The transfer material 48 to which the toner image is transferred is separated from the carry belt 47, conveyed to a fixing unit (not shown), and the toner image is fixed thereon to be converted into a permanent image. Also, residual toner remaining on the photosensitive drum 40 after the transfer is removed by a cleaner 50.

Furthermore, in addition to an oscillator 65 for generating a clock pulse for estimating a toner amount used for the image forming, an AND gate 64 and a counter 66 are illustrated in FIG. 1. Also, a toner density sensor 20 for detecting toner density in the developing unit 44, an amplifier 21, or the like, are also illustrated. A replenishment controller 110 comprises the CPU 67 and a storage unit 68 and controls a toner replenishment amount.

Figure 2:
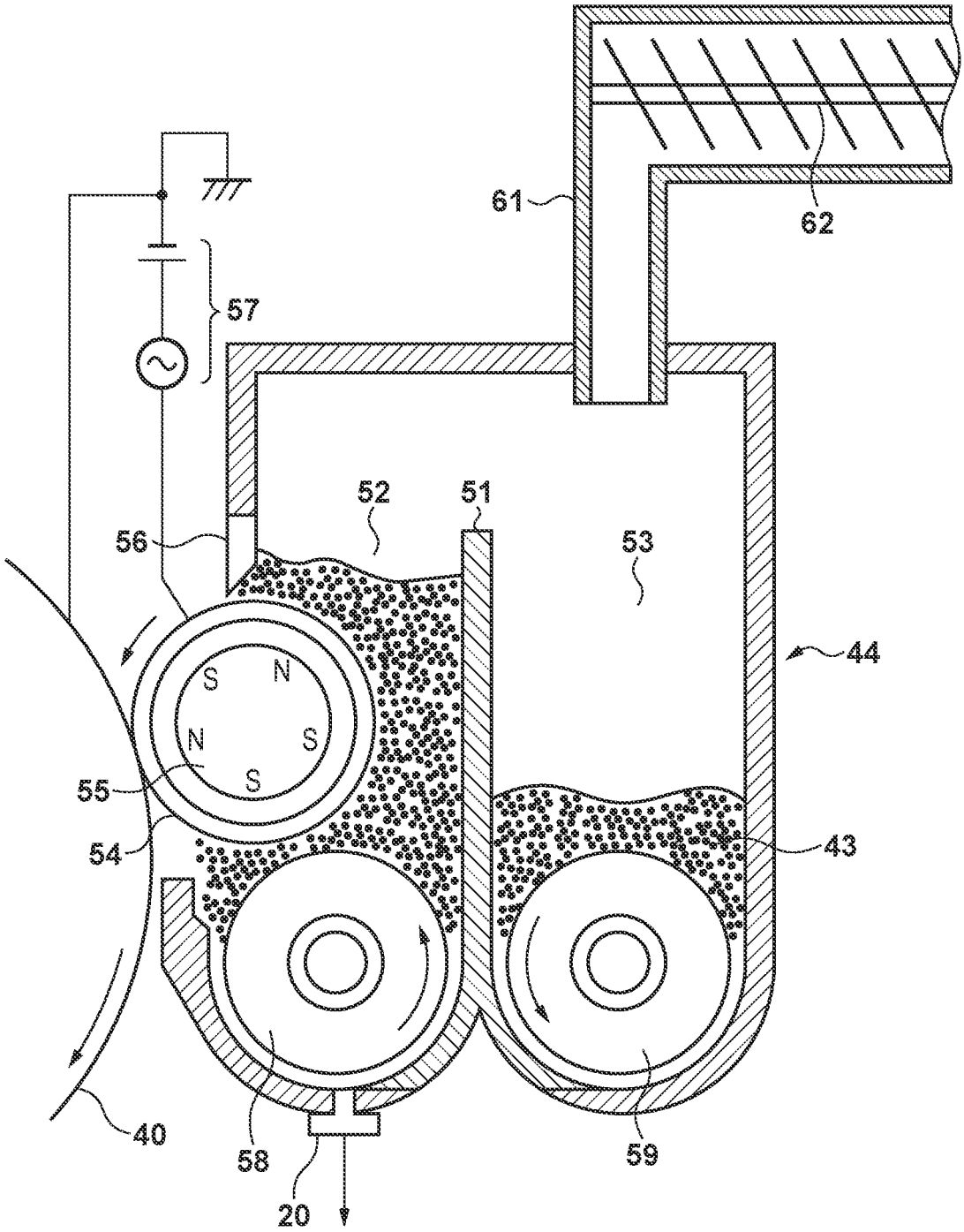
FIG. 2 is an overview cross-sectional view illustrating an example of a developing unit.

The toner density sensor 20 is arranged on the developing unit 44 in order to detect toner density (the T/D ratio) in the two-component developer stored in the developing unit 44. The toner density sensor is, for example, an inductor sensor. Also, an optical T/D ratio sensor may be employed as the toner density sensor. The present embodiment can use a sensor if it can detect the T/D ratio, and is not dependent upon the detection method. An example of the developing unit 44 is explained with reference to FIG. 1 and FIG. 2. The developing unit 44 is arranged to face the photosensitive drum 40, and the interior is separated into a first chamber (developing chamber) 52 and a second chamber (mixing chamber) 53 by a partition 51 extending in a vertical direction. A non-magnetic developing sleeve 54 rotating in the arrow symbol direction is arranged in the first chamber 52. The developing sleeve 54 functions as a conveyer unit for conveying the developer 43 to the image carrier. A magnet 55 is fixed in the developing sleeve 54. The developing sleeve 54 carries and conveys two-component developer, supplies the developer 43 to the photosensitive drum 40 in a developing region facing the photosensitive drum 40, and thereby develops the electrostatic latent image. A thickness of a toner layer on the developing sleeve 54 is regulated by a blade 56. In order to improve a developing efficiency, i.e. a rate at which toner is added to the latent image, a developing voltage in which a direct current voltage from a power supply 57 is superimposed on an alternating voltage is applied to the developing sleeve 54.

In the first chamber 52, a screw 58 is arranged. The screw 58 functions as a first circulator unit for, in addition to mixing the developer 43 existing in the first chamber 52, causing the developer 43 to circulate between the first chamber 52 and the second chamber 53. In the second chamber 53, a screw 59 is arranged. The screw 59 functions as a second circulator unit for, in addition to mixing the developer 43 present in the second chamber 53 and toner 63 supplied by a toner replenishment basin 60, causing the developer 43 to circulate between the first chamber 52 and the second chamber 53. Also, the screws 58 and 59 function as a circulation mechanism for causing the developer 43 to circulate within the developing unit 44. A conveying screw 62 conveys toner of the toner replenishment basin 60 while rotating, and supplies toner from a toner discharging port 61 to the second chamber 53. By the screw 59 mixing the toner 63 supplied from the toner replenishment basin 60 with the developer 43 already present in the developing unit 44, the density of toner particles in the developer 43 (toner density)

becomes uniform. In the partition 51, paths (not shown) by which the first chamber 52 and the second chamber 53 communicate with each other are formed at a front side end portion and a far side end portion in FIG. 2. For the developer 43 in the first chamber 52, by developing, the toner is consumed, and the toner density is lowered. The developer 43 in the first chamber 52 moves from a path on one side to within the second chamber 53 by the screw 58. The developer 43, for which the toner density is recovered in the second chamber 53, moves into the first chamber 52 from the path on the other side by the screw 59.

On a bottom wall of the first chamber (developing chamber) 52 of the developing unit 44 the toner density sensor 20, which is a toner density detector unit, is installed. The toner density sensor 20 is a detector unit for detecting a toner density of the developer 43 present within the first chamber 52 of the developing unit 44. The toner density sensor 20 is an inductance sensor, or the like, for detecting a permeability of the developer 43. The toner density sensor outputs a detected value corresponding to the toner density to the replenishment controller 110. The replenishment controller 110 functions as a control/determination unit for controlling/determining an amount of toner to replenish the developing unit 44 with so that the toner density detected by the toner density sensor approaches a target density.

The counter 66 is a consumed toner calculation unit according to a video counting method, and counts the level of the output signal of the image processing circuit 34 for every pixel. An output signal of the pulse width modulation circuit 35 is supplied to one input of the AND gate 64, and a clock pulse from the oscillator 65 is supplied to the other input of the AND gate 64. Accordingly, the AND gate 64 outputs clock pulses of a number corresponding to the pulse widths of the laser driving pulse, i.e. clock pulses of a number corresponding to the density for each pixel. The counter 66 obtains a video count value by accumulating a clock pulse number for each image (an original) (a maximum video count value for an A4 original is 3707×106). A pulse accumulation signal (the video count value) for each image from the counter 66 corresponds to a toner amount consumed in the developing unit 44 in order to form 1 toner image of the original 31. There are various counters or the like for counting directly from image data for synchronizing the laser driving pulse other than a video counter such as the counter 66, and any counter can be applied to the present invention.

The replenishment controller 110 determines the replenishment amount for the toner 63 based on the video count value and the output of the toner density sensor, and controls a replenishment motor 70 which is a toner replenisher unit through a motor driver 69. A driving time and a number of operations of the replenishment motor 70 are proportional to the replenishment amount essentially. A driving force of the replenishment motor 70 is transmitted to the conveying screw 62 via a gear array 71. The conveying screw 62 replenishes the developing unit 44 by conveying the toner 63 within the toner replenishment basin 60.

<Replenishment Control>

Figure 3:
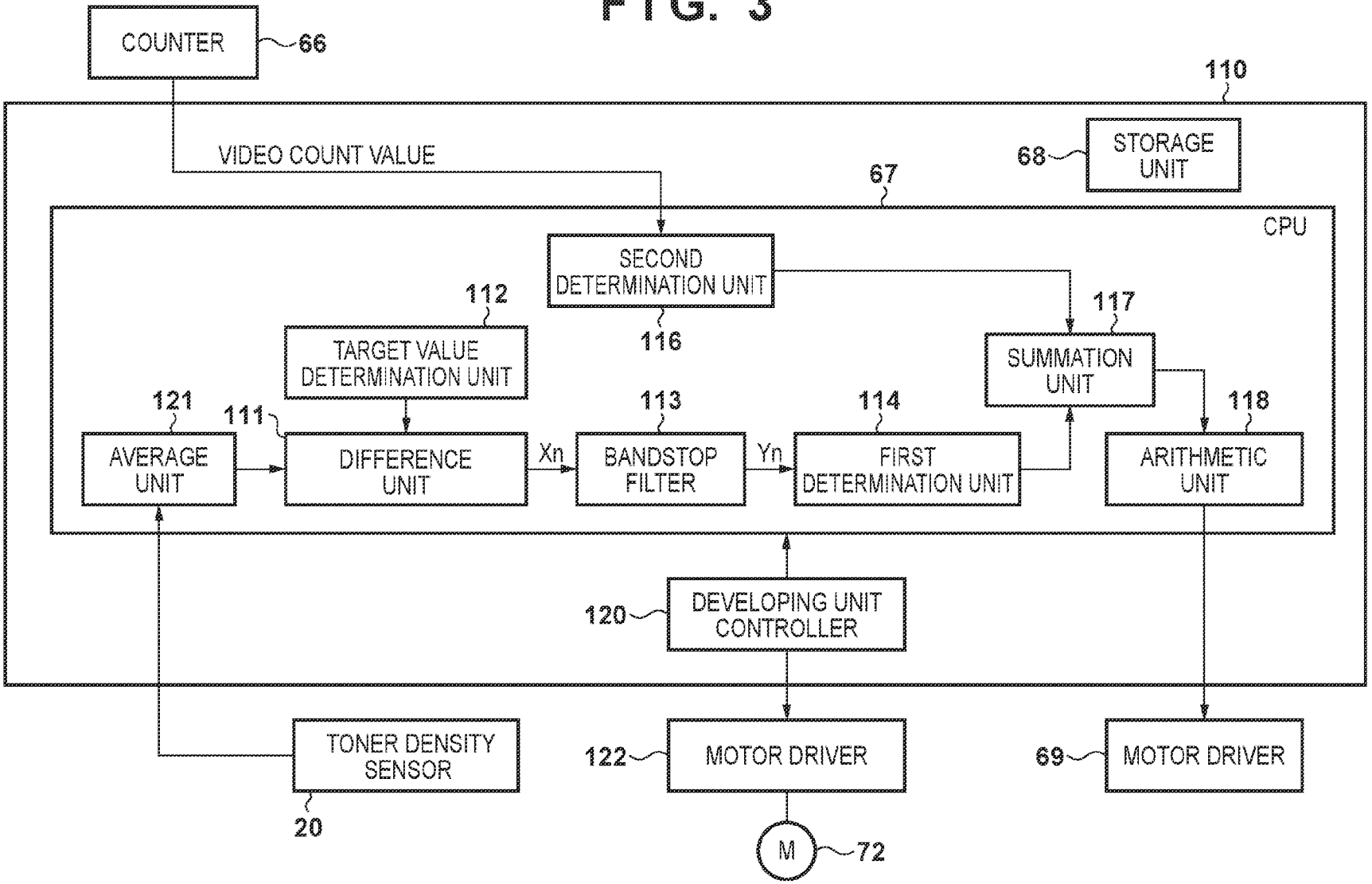
FIG. 3 is a block diagram for illustrating an example of a replenishment controller.

FIG. 3 is a block diagram for the replenishment controller 110 of the embodiment. The replenishment controller 110 in particular comprises a bandstop filter 113 and a first determination unit 114. The bandstop filter 113 is an example of a filter unit for reducing a long period ripple that occurs in accordance with a circulation period of the developer 43 in accordance with the screws 58 and 59 in the toner density detected by the toner density sensor. The first determination unit 114 is an example of a first determination unit for determining a first replenishment amount among replenishment amounts based on the toner density for which the long period ripple is reduced by the bandstop filter 113. For other functions illustrated by FIG. 3, explanation is given with reference to FIG. 4. A ripple period generated in accordance with a developer circulation period is, for example, 30 seconds, 60 seconds or the like. Meanwhile, a short period ripple occurs in the toner density in accordance with a rotation period (a mixing period) of the screws 58 and 59. This ripple period is, for example, around 0.1 seconds, 0.2 seconds or the like. The short period ripple is reduced by an average unit 121.

Figure 4:
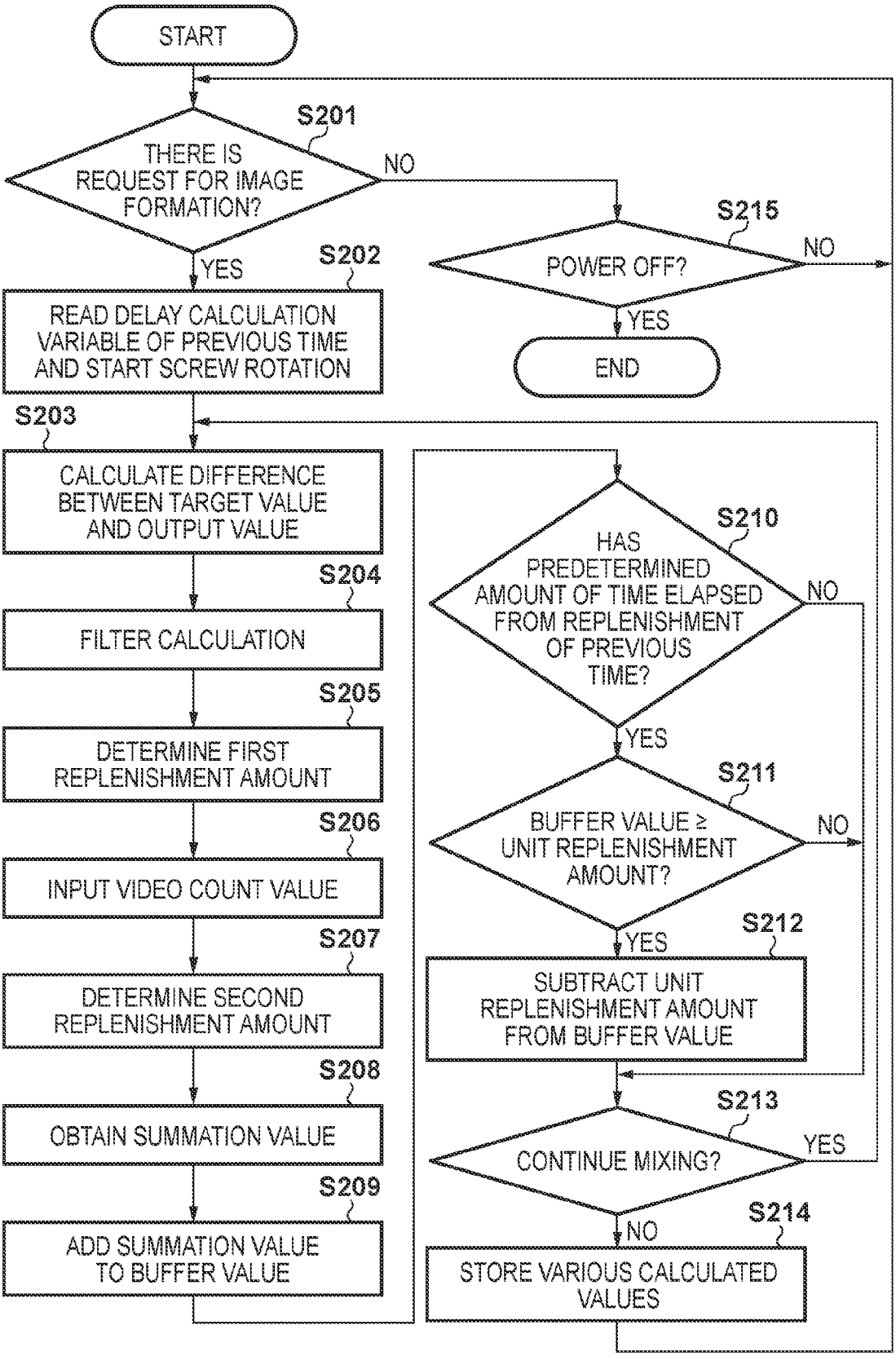
FIG. 4 is a flowchart for illustrating an example of a replenishment control.

FIG. 4 is a flowchart for illustrating an operation of the CPU 67. The various functions illustrated in FIG. 3 are realized by the CPU 67 reading a control program from a ROM of the storage unit 68 and executing it when power is supplied from the external power supply to the image forming apparatus and it activates. Note that these functions may be performed by hardware by logic circuits.

In step S201, the CPU 67 enters a standby state, and determines whether or not an image formation request is received from the operation unit or an external computer. If there is no request for image formation, the CPU 67 proceeds to step S215. In step S215, the CPU 67 determines whether or not a power OFF was instructed from the operation unit. If a power OFF is not instructed, the CPU 67 returns to step S201. If a power OFF is instructed, the CPU 67 executes a shutdown of the image forming apparatus. If there is a request for image formation in step S201, the CPU 67 proceeds to step S202.

In step S202, the CPU 67 reads the delay calculation variable of the previous time stored in RAM of the storage unit 68, and instructs a developing unit controller 120 to rotate the screws 58 and 59. The developing unit controller 120 causes a motor driver 122 to drive a developing motor 72. The developing motor 72 causes the screws 58 and 59 to rotate.

In step S203, the CPU 67 (a difference unit 111) calculates to obtain a difference between an output value of the average unit 121 and a target value set by a target value determination unit 112. The average unit 121 is a function for smoothing output of the toner density sensor. Also, the average unit 121 may also function as a reduction unit for reducing a short period ripple that occurs in the toner density in accordance with the mixing period.

In step S204, the CPU 67 (the bandstop filter 113) obtains Yn by executing a filter calculation using the following equation with respect to a difference Xn outputted from the difference unit 111.

$$Yn=b0\times Xn+P_{n-1} \quad (1)$$

$$Pn=b1\times Xn-a1\times Yn+Q_{n-1} \quad (2)$$

$$Qn=b2\times Xn-a2\times Yn \quad (3)$$

Here, Xn is the current output value of the difference unit 111. Yn is this time's output value of the bandstop filter 113. Pn and Qn are delay calculation variables for this time. $P_{n-1}$ and $Q_{n-1}$ are delay calculation variables of the previous time, and are read out from the storage unit 68. The CPU 67 stores the delay calculation variables Pn and Qn obtained by the calculation this time in the storage unit 68, and uses them in the calculation of the next time. The coefficients a1, a2, b0, b1, and b2 are filter coefficients determined in advance at the time ofdesigning the image forming apparatus, at the time of shipment from the factory, or the like. In the present embodiment, Yn is calculated every 0.1 seconds.

Figure 5A:
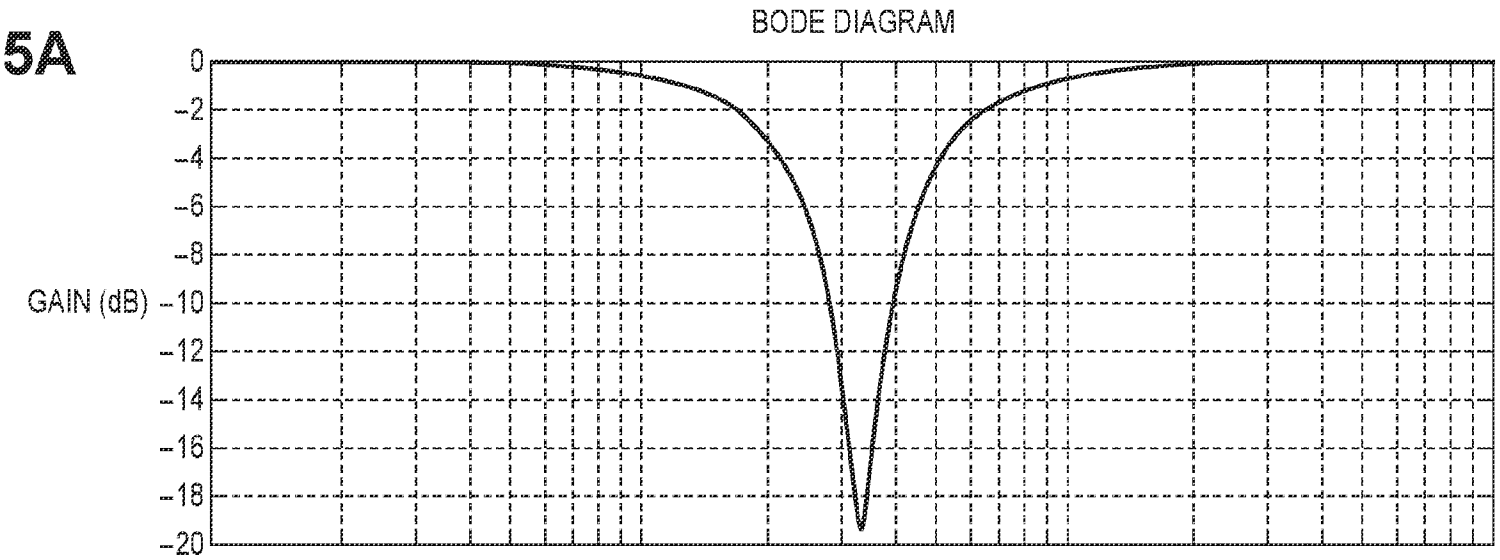
FIGS. 5A and 5B are views for illustrating an example of a characteristic of a bandstop filter.
Figure 5B:
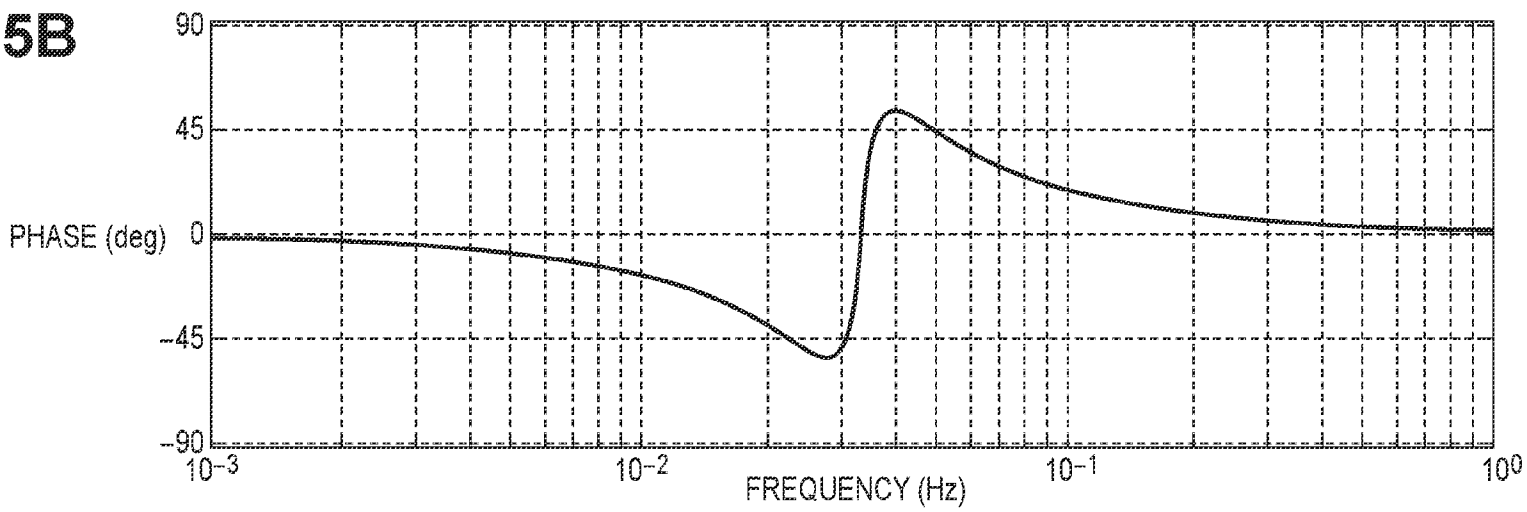

FIG. 5A is a Bode diagram for illustrating a relationship between frequency and gain for the bandstop filter 113. FIG. 5B is a Bode diagram for illustrating a relationship between frequency and phase for the bandstop filter 113. FIG. 5A and FIG. 5B illustrate reducing an input ripple of a 30 second period. Coefficients for configuring the bandstop filter 113 which has such a characteristic are as follows.

$$a1=-1.97723 \quad (4)$$

$$a2=0.977668 \quad (5)$$

$$b0=0.990025 \quad (6)$$

$$b1=-1.97723 \quad (7)$$

$$b2=0.987643 \quad (8)$$

In this way, these coefficients are determined in advance in accordance with a period of a ripple to be reduced.

In step S205, the CPU 67 (the first determination unit 114) determines a first replenishment amount based on the output value Yn of the bandstop filter 113. The first determination unit 114 is a PI controller (proportional integration controller), which adds the current output value Yn and the accumulated value Tn of the output values up until the previous time to determine a first replenishment amount R1*n*.

$$R1n=g1\times Yn+g2\times Tn \quad (9)$$

$$Tn=T_{n-1}+Yn \quad (10)$$

g1 and g2 are gains, and are coefficients that are set in advance.

In step S206, the CPU 67 (a second determination unit 116) inputs the video count value from the counter 66. In step S207, the CPU 67 (the second determination unit 116) determines a second replenishment amount R2*n* by applying a calculation explained later to the video count value. In step S208, the CPU 67 (a summation unit 117) summates the first replenishment amount R1*n* and the second replenishment amount R2*n* to obtain a summation value Rn (Rn=R1*n*+R2*n*). In step S209, the CPU 67 (an arithmetic unit 118) adds the summation value Rn to a buffer value Bn of a replenishment amount ($Bn=B_{n-1}+Rn$). Note that the initial value of the buffer value Bn is, for example, zero.

In step S210, the CPU 67 determines whether or not the elapsed time from when the motor driver 69 was instructed for replenishment the previous time exceeds a predetermined amount of time. The CPU 67 counts the elapsed time from when replenishment is instructed using a timer, a counter or the like. The CPU 67 resets the timer to zero when replenishment is instructed. When replenishment is instructed, the motor driver 69 drives the replenishment motor 70, causing the screws 58 and 59 to rotate, and replenish the developing unit 44 with the toner 63. If the elapsed time does not exceed the predetermined amount of time, the CPU 67 proceeds to step S211. If the elapsed time does exceed the predetermined amount of time, the CPU 67 proceeds to step S213. The predetermined amount of time is a time for allowing the toner density to become uniform in the developing unit 44, and is determined in advance by experimentation, simulation, or the like. If the next replenishment is executed in a state in which mixing of the developer 43 and the toner 63 in the developing unit 44 is insufficient, it will result in a localized dense portion in the toner density in the developing unit 44. Accordingly, by continuing mixing across a predetermined amount of time from the start of replenishment, and permitting replenishment thereafter, uniformization of the toner density is achieved.

In step S211, the CPU 67 (the arithmetic unit 118) determines whether or not the buffer value Bn reaches a predetermined unit replenishment amount r or greater. If the buffer value Bn is the unit replenishment amount r or greater, the CPU 67 proceeds to step S212. If the buffer value Bn is not the unit replenishment amount r or greater, the CPU 67 proceeds to step S213.

In step S212, the CPU 67 (the arithmetic unit 118) in addition to instructing the motor driver 69 for replenishment, subtracts the unit replenishment amount r from the buffer value Bn. The motor driver 69, in accordance with the instruction, drives the replenishment motor 70 to replenish the developing unit with the toner 63.

In step S213, the CPU 67 determines whether or not to continue mixing by the screws 58 and 59. For example, the CPU 67 determines that mixing should be continued if image formation by an image formation request detected in step S201 continues. Also, the CPU 67 determines that mixing should be stopped if image formation terminates. If mixing continues, the CPU 67 returns to step S203, and the CPU 67 calculates the next difference. If mixing should be stopped, the CPU 67 proceeds to step S214. In step S214, the CPU 67 causes various calculated values (example: the delay calculation variables Pn, Qn, and Bn, or the like) to be stored in the storage unit 68. Note that the buffer value Bn, the first replenishment amount R1*n*, the second replenishment amount R2*n* or the like are reset to zero. After that, the CPU 67 returns to step S201. In this way, the sequence of processing from step S203 to step S213 is something that is performed every 0.1 seconds, for example. For that reason, the unit replenishment amount r corresponds to a toner amount replenished every 0.1 seconds.

<Second Replenishment Amount Determination Method>

In the present embodiment, the processing for determining the replenishment amount for which the output value of the toner density sensor is fed back is executed in intervals of 0.1 seconds during operation of the screws 58 and 59. However, the video count value is an accumulation value for 1 image. If the accumulation value is converted into a replenishment amount unchanged, the replenishment amount for every 0.1 seconds will be excessive. This is because the first replenishment amount R1*n* is determined based on an output value of the toner density sensor 20 which is output every 0.1 seconds. Accordingly, the second replenishment amount R2*n* determined based on the video count value is also made to be a replenishment amount distributed for every 0.1 seconds. Accordingly, the second determination unit 116 outputs a replenishment amount based on the video count value divided over a predetermined number of times.

Figure 6:
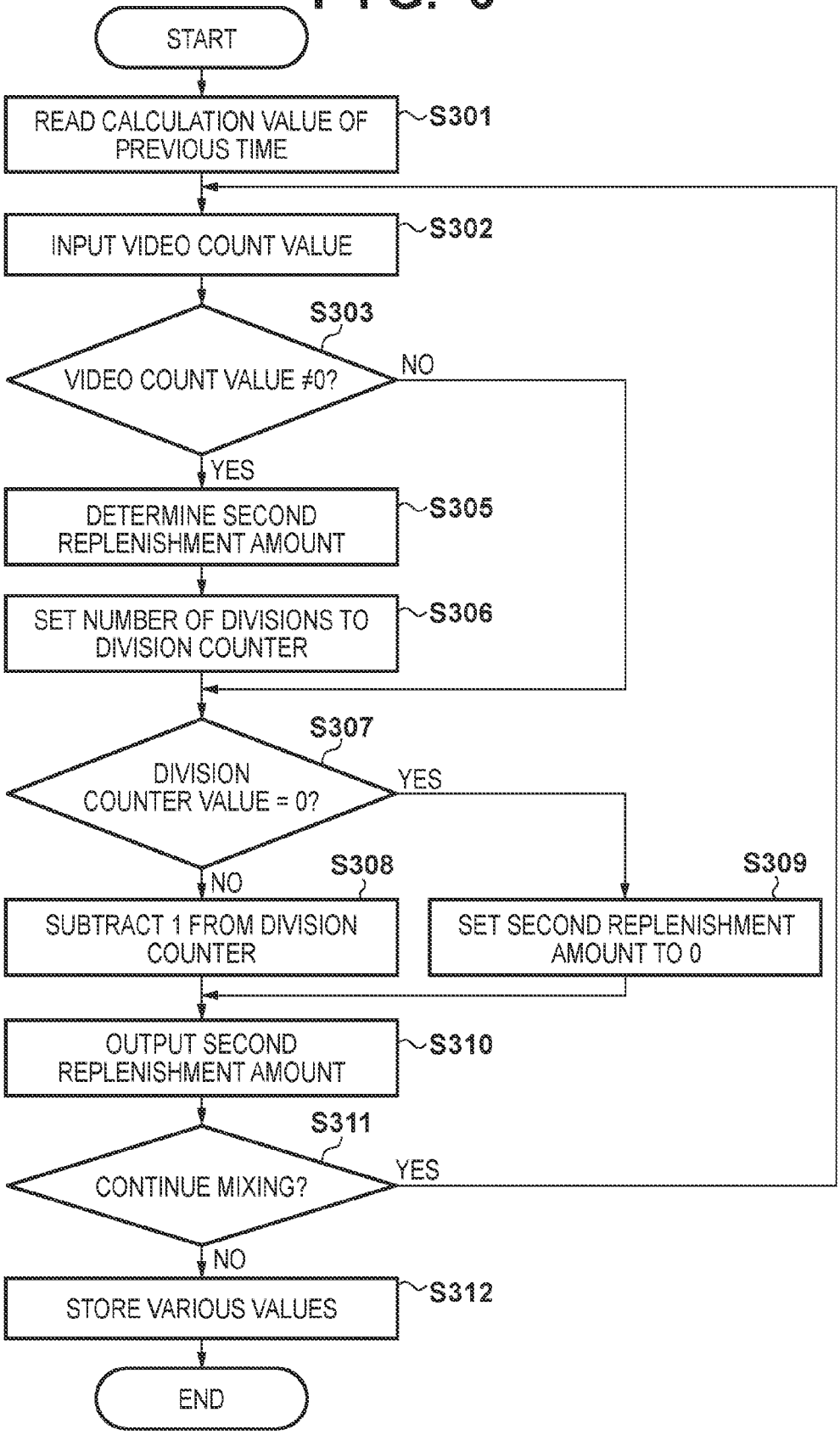
FIG. 6 is a flowchart for illustrating an example of a method for determining a replenishment amount based on a toner consumption amount.

FIG. 6 is a flowchart for illustrating an operation of the CPU 67 (the second determination unit 116). The second determination unit 116 starts a calculation for determining the replenishment amount at the same time as starting rotation of the screws 58 and 59.

In step S301, the second determination unit 116 reads out a calculated value of the previous time from the storage unit 68. In step S302, the second determination unit 116 inputs the video count value (the accumulation value) from the counter 66. When the second determination unit 116 performs input of a video count value, the video count value is reset to zero. Step S302 is performed every 0.1 seconds across a period in which the screws 58 and 59 are rotating, but until an accumulation of the video count value for 1 image ends, 0 is input as the video count value. At the point in time when the accumulation ends, the accumulation value is inputted one time.

In step S303, it is determined whether or not the video count value that the second determination unit 116 inputted is 0. If the video count value is 0, the second determination unit 116 proceeds to step S307 without modifying the current second replenishment amount. If the video count value is not 0, the second determination unit 116 proceeds to step S305.

In step S305, the second determination unit 116 determines a second replenishment amount U2*k*. The second determination unit 116 causes a memory such as the storage unit 68 to store the determined second replenishment amount U2*k*. The second replenishment amount U2*k* is determined by the following formula, for example.

$$U2k=g2\times(U2_{k-1}\times C+V)=D \quad (11)$$

Here, U2*k* is a second replenishment amount determined this time, and is a calculated value of the previous time read in step S301. Here, $U2_{k-1}$ is the second replenishment amount determined the previous time. V is the inputted video count value (the accumulation value). D is a number of divisions. C is a value of a division counter when the video count value is input. In other words, the element $U2_{k-1}\times C$ means the replenishment amount carried over from the previous time. Before replenishing all of the toner based on the video count value input the previous time, the next print job is generated. In such a case, the toner replenishment amount based on the video count value input the previous time is carried over. The division counter C is an integer greater than or equal to 0, and an initial value is the number of divisions D. Until the division counter C becomes 0, it is decremented by 1 every 0.1 seconds in step S308. In this way, because the division counter executes a countdown from D, a remaining amount of toner replenishment is obtained by multiplying $U2_{k-1}$ with a division counter value C when the video count value based on the next page is generated.

Additionally, U2*k* is updated every time step S305 is executed. In other words, for U2*k*, step S305 is executed, or U2*k* is used as R2*n* without being updated until the count value C becomes zero. As described above, there are cases in which a first video count value is input, and before replenishment of toner of the replenishment amount corresponding to this finishes, the next video count value is input. In other words, it is necessary to carry over the remaining amount in the total replenishment amount for the first video count value to the replenishment amount for the next video count value. The element $U2_{k-1}\times C$ means this carried over replenishment amount. For example, when the next video count value is input immediately for the first video count value, C is still a large value, and a large portion of the replenishment amount corresponding to the first video count value is carried over. If C is zero, the replenishment amount corresponding to the first video count value is not carried over.

In this way, if the division counter C is not 0, the output of the division replenishment amount for the video count value of the previous time has not ended. For this reason, as is illustrated in formula (11), the second determination unit 116 obtains the second replenishment amount U2*k* by summating a remaining replenishment number ($U2_{k-1}\times C$) and the video count value V input newly. If the division counter C is 0, the second determination unit 116 determines the second replenishment amount U2*k* from the video count value V of this time. The second replenishment amount determined here is subsequently used as the second replenishment amount R2*n* (R2*n*=U2*k*).

In step S306, the second determination unit 116 sets the number of divisions D to the division counter C.

$$C=D \quad (12)$$

In step S307, the second determination unit 116 determines whether or not the division counter C is 0. Because the division replenishment based on the video count value V is not completed if the division counter C is not 0, the second determination unit 116 proceeds to step S308. In step S308, the second determination unit 116 subtracts 1 from the division counter C. Meanwhile, because if the division counter C is 0, the division replenishment is completed, the second determination unit 116 proceeds to step S309. In step S309, the second determination unit 116 sets the second replenishment amount R2*n* to 0. The second determination unit 116 causes the storage unit 68 to store the second replenishment amount R2*n*. In other words, the second replenishment amount R2*n* held in the storage unit 68 is reset to zero.

In step S310, the second determination unit 116 reads the second replenishment amount R2*n* from the storage unit 68 and outputs it to the summation unit 117. In step S311, the second determination unit 116 determines whether or not mixing should be continued. The method of the determination of step S311 is similar to that of step S213. If mixing should be continued, the second determination unit 116 returns to step S302. If mixing should be stopped, the second determination unit 116 proceeds to step S312. In step S312, the second determination unit 116 causes the storage unit 68 to store the division counter C and the second replenishment amount R2*n*.

<Processing Accompanying Introduction of Bandstop Filter>

While the screw 58 is rotating, a ripple of a particular frequency occurs in the detected values of the toner density sensor. A long period ripple frequency is the reciprocal of the developer circulation period. The bandstop filter 113 is arranged in order to reduce this long period ripple in the detected value of the toner density sensor 20. Furthermore, a short period ripple occurs in accordance with the mixing period (rotation period) of the screw 58. While the ripple period accompanying developer circulation is around 30 seconds, the ripple period accompanying the rotation period is around 0.1 seconds. The numerical values of these periods are merely examples. Accordingly, a unit for reducing a short period ripple is necessary. Note that while the screw 58 is rotating, detected values of the toner density sensor are obtained at predetermined intervals.

Figure 7A:
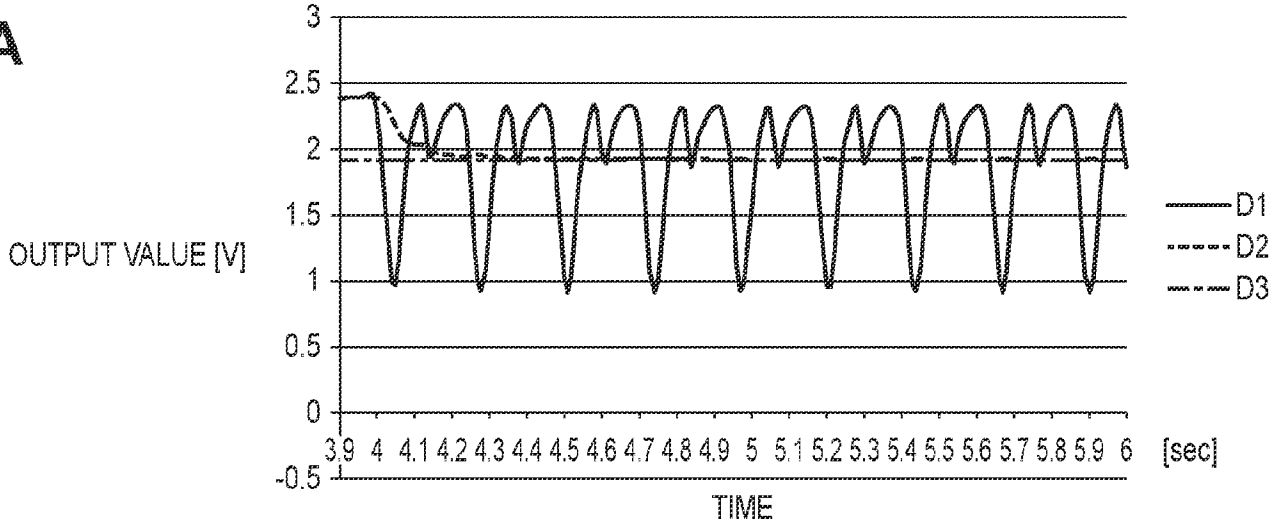
FIGS. 7A and 7B are views for explaining an effect of an average unit.
Figure 7B:
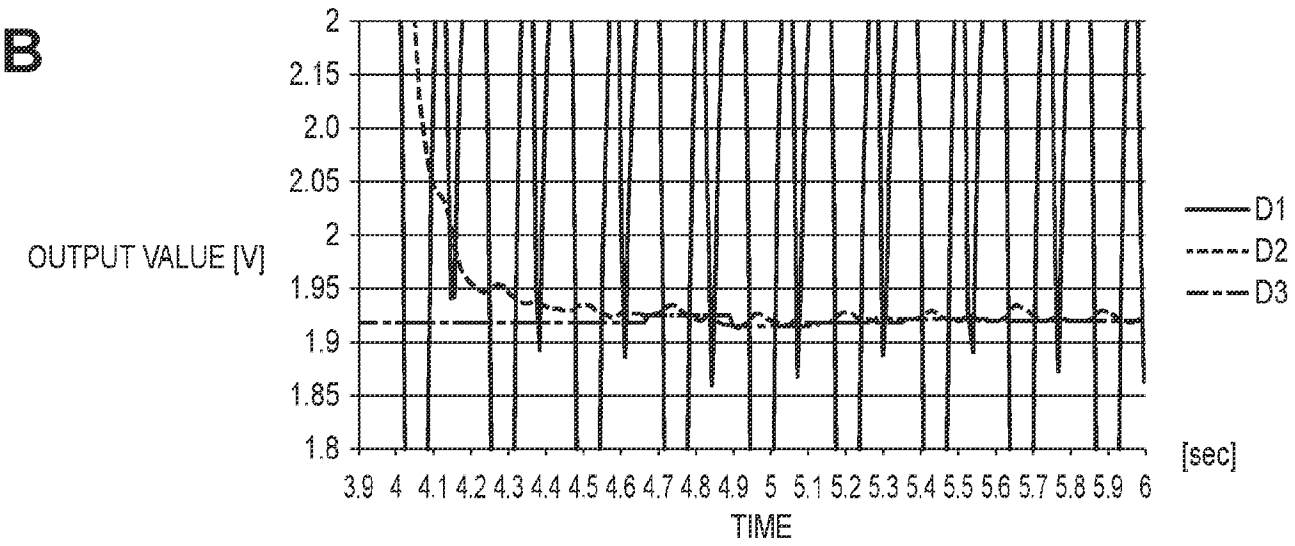

FIG. 7A exemplifies detected values D1 of the toner density sensor, a moving average D2 of the detected values, and average values D3 accompanying an initial mask. FIG. 7B is a view for magnifying a portion of an interval in which the initial mask is applied in FIG. 7A. In FIG. 7A and FIG. 7B, a solid line illustrates the detected values D1 of the toner density sensor. The broken line illustrates the moving average D2 of the detected values. The dashed-dotted line illustrates the average values D3 accompanying the initial mask.

As is illustrated by the solid line of FIG. 7A and FIG. 7B, the detected values D1 of the toner density sensor pulsate accompanying the rotation of the screw 58. This is because the toner density of the developer 43 detected by the toner density sensor fluctuates in accordance with the rotation period of the screw 58. Accordingly, the average unit 121 averages the detected values D1 in accordance with the rotation period of the screw 58, and outputs the average values to the difference unit 111.

In a case where a replenishment amount is calculated for each page, if averaging is executed with a sufficient margin from when the screw 58 starts rotating, the short period ripple will become smaller. However, for the bandstop filter 113, detected values of the toner density sensor in a predetermined interval when the screw 58 is rotating are necessary. In other words, average values are necessary immediately when the screw 58 starts rotating.

As the broken lines of FIG. 7A and FIG. 7B illustrate, when the moving average D2 is obtained for the detected values D1 of the toner density sensor simply, the moving average D2 does not converge at the point where rotation of the screw 58 starts. Accordingly, the average unit 121 performs averaging processing by a flow illustrated in FIG. 8. In particular, the average unit 121 executes averaging by masking an unstable region generated across a predetermined period immediately after the rotation of the screw 58 starts. This brings about an effect that the memory capacity required for the calculation can be reduced. In this way, the average unit 121 is an example of a mask unit that masks the toner density output from the toner density sensor across a predetermined period from when the screws 58 and 59 start operation so that it is not reflected in the first replenishment amount R1*n*.

Figure 8:
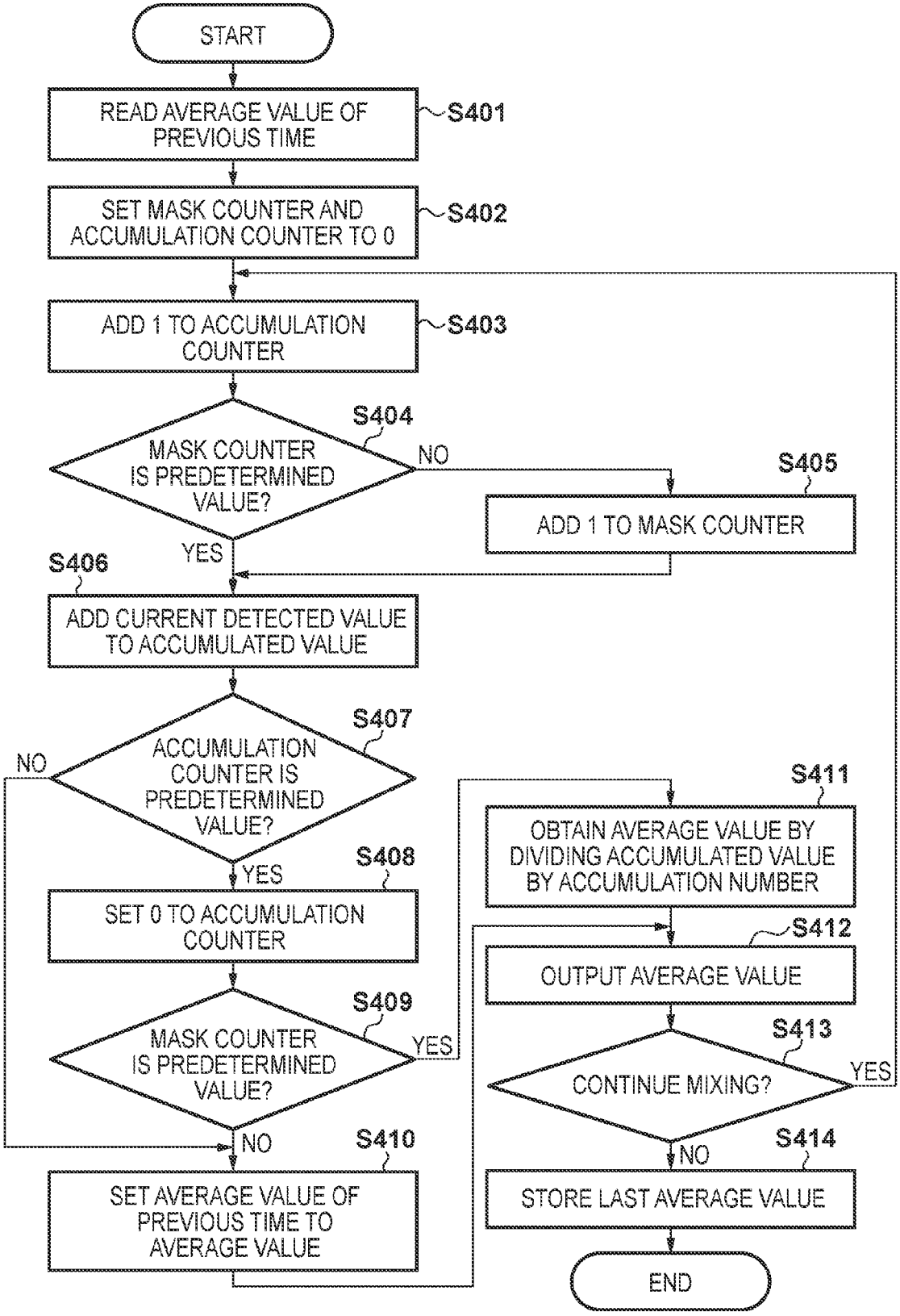
FIG. 8 is a flowchart for illustrating an example of averaging and mask processing.

Using FIG. 8, explanation is given for an averaging calculation that the average unit 121 executes. The average unit 121 starts a calculation for averaging when the screws 58 and 59 start rotating.

In step S401, the average unit 121 reads from the storage unit 68 the last averaging output value (an average value) saved when the screws 58 and 59 stopped the previous time. In step S402, the average unit 121 sets the mask counter Cm and the accumulation counter Ca to 0. The mask counter Cm is a counter for managing the target of masking in the detected values D1 of the toner density sensor. The accumulation counter Ca is a counter for counting how many times the detected values D1 are accumulated. In step S403, the average unit 121 adds 1 to the accumulation counter Ca. In step S404, the average unit 121 determines whether or not the mask counter Cm reaches a predetermined value Cmx. The predetermined value Cmx indicates a total number of the masked average value. If the mask counter Cm is the predetermined value Cmx, the average unit 121 proceeds to step S406. If the mask counter Cm is not the predetermined value, the average unit 121 proceeds to step S405. In step S405, the average unit 121 adds 1 to the mask counter Cm.

In step S406, the average unit 121 adds (an accumulation calculation) the current detected value D1 of the toner density sensor to the accumulated value Da of the detected value D1. In step S407, the average unit 121 determines whether or not the accumulation counter Ca reaches the predetermined value Cax. If the accumulation counter Ca does not reach the predetermined value Cax, the average unit 121 skips step S408 and step S409 and proceeds to step S410. The predetermined value Cax is the accumulated total number of the detected values D1, and is predetermined. If the accumulation counter Ca reaches the predetermined value Cax, the average unit 121 proceeds to step S408.

In step S408, the average unit 121 sets the accumulation counter Ca to 0. In step S409, it is determined whether or not the mask counter Cm reaches a predetermined value Cmx. The value of the predetermined value Cmx, as FIG. 7B illustrates, corresponds to the time from the time at which the screw 58 starts rotating to the time at which the moving average D2 finally converges with the average values D3. If the mask counter Cm does not reach the predetermined value Cmx, the initial fluctuation component remains in the detected value D1, and so it should be masked. Accordingly, the average unit 121 proceeds to step S410. Note that, if the mask counter Cm reaches the predetermined value Cmx, the initial fluctuation component does not remain in the detected values D1, and so masking is not necessary. Accordingly, the average unit 121 proceeds to step S411.

In step S410, the average unit 121 sets an average value D3' of the previous time stored in the storage unit 68 as the average value D3 output to the difference unit 111. In step S411, the average unit 121 obtains the average value D3 by dividing the accumulated value Da by the predetermined value Cax which is the accumulation number. In step S412, the average unit 121 outputs the average value D3 to the difference unit 111. In step S413, the average unit 121 determines whether or not mixing should be continued. This is determination processing similar to that of step S213 and step S311. If mixing should be continued, the average unit 121 returns to step S403. If mixing should be stopped, the average unit 121 proceeds to step S414. In step S414, the average unit 121 causes the storage unit 68 to store the last average value D3.

In this way, in accordance with this embodiment, by using the bandstop filter 113, a long period ripple that occurs in the toner density depending on the developer circulation period can be reduced. Furthermore, by using the average unit 121, a short period ripple that occurs in the toner density depending on the mixing period of the screws 58 and 59 can be reduced. Furthermore, by masking the toner density obtained in a predetermined period from when rotation of the screws 58 and 59 starts among the detected values of the toner density, an influence of an initial rotation fluctuation component can be reduced. Note that, by using the average value D3' of detected values in the past in the predetermined period, it is possible to prepare data necessary for the bandstop filter 113.

Note that, in accordance with this embodiment, with respect to the difference Xn, which is an output value from the difference unit 111, filter processing is performed using the bandstop filter 113. As a variation, in place of performing the filter processing on the difference Xn, filter processing may be performed using the bandstop filter with respect to the output value of the toner density sensor 20 or the output value of the average unit 121. Also, in place of performing filter processing on the difference Xn, the filter processing may be performed using the bandstop filter on the first replenishment amount R1*n* outputted from the first determination unit 114.

<Comparative Example 1>

Explanation will be given to comparative example 1 to explain the effect of the embodiment. Comparative example 1 is something that omits the bandstop filter 113 and the average unit 121 from the embodiment. The comparative example 1 is not a publicly known example.

Figure 9:
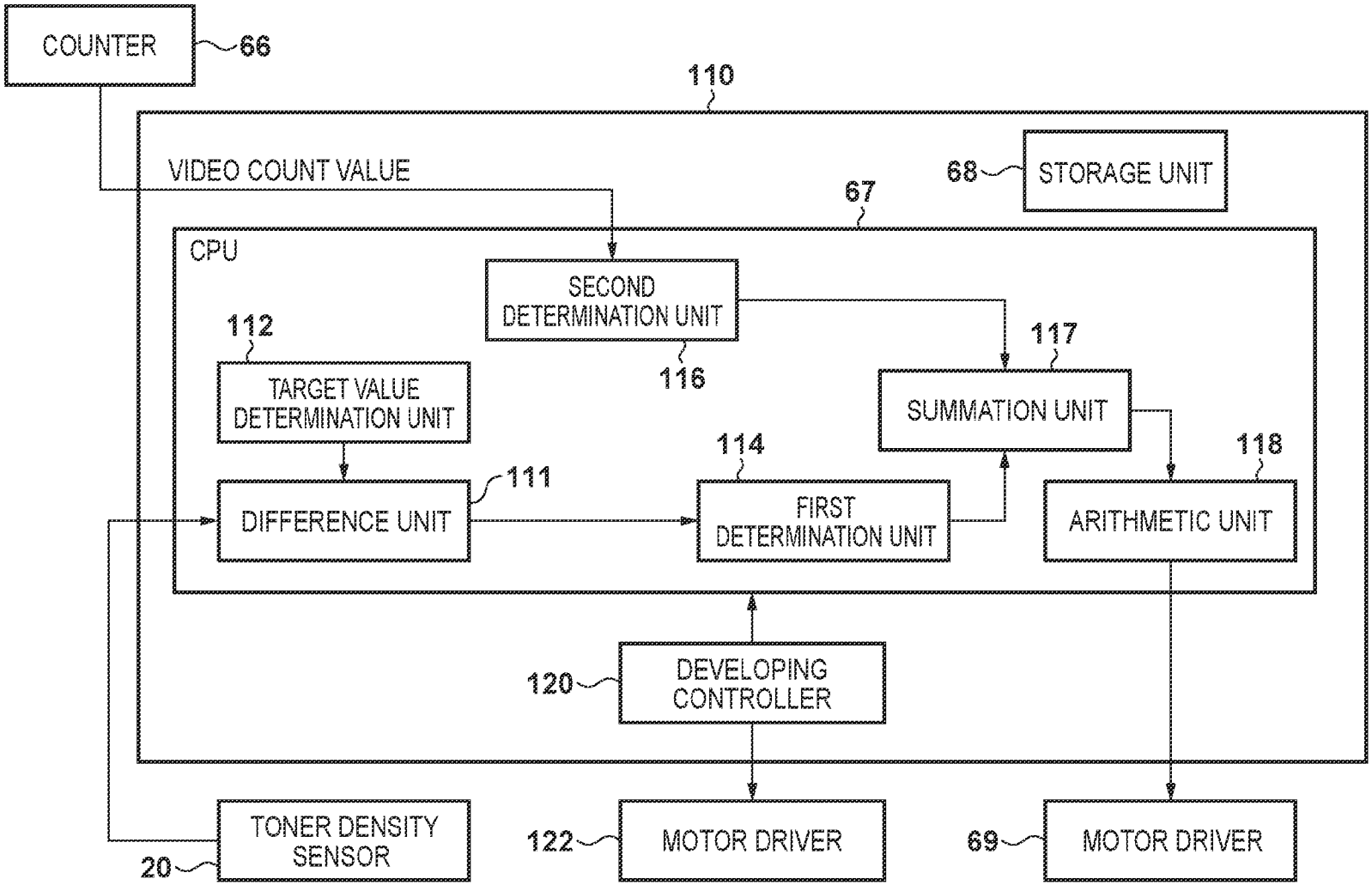
FIG. 9 is a block diagram for illustrating a replenishment controller of a comparative example 1.

FIG. 9 is a block diagram for the replenishment controller of comparative example 1. Because the average unit 121 is omitted, the difference unit 111 calculates the difference Xn between a detected value D1*n* from the toner density sensor and a target value Dt determined by the target value determination unit 112. Also, because the bandstop filter 113 is omitted, the first determination unit 114 determines as the first replenishment amount R1*n* a sum of something for which a predetermined gain g1 is multiplied with the difference Xn of this time, and something for which a predetermined gain g2 is multiplied with the accumulated value Tn of the difference up until the previous time.

$$R1n=g1\times Xn+g2\times Tn \quad (13)$$

$$Tn=T_{n-1}+Xn \quad (14)$$

Note that the second replenishment amount R2*n* of comparative example 1 is the same as that of the embodiment. The flowchart of comparative example 1 is something that omits steps related to the bandstop filter 113 and the average unit 121 from the flowchart of the embodiment. Specifically, steps that are omitted are the variable read out of step S202 and the filter calculation of step S204, or the like.

<Comparative Example 2>

The comparative example 2, is something in which in step S207 of the first embodiment, processing for dividing the replenishment amount based on the video count value illustrated in FIG. 6 over a predetermined number of times and outputting is omitted. In other words, the replenishment amount converted from the video count value (the accumulation value for 1 image) is reflected in the summation value in one go. The comparative example 2 is not a publicly known example.

In the comparative example 2, processing other than the processing illustrated in FIG. 6 and that of step S207 of the embodiment is the same as in the embodiment. In other words, the block diagram of the comparative example 2 is the same as in FIG. 3. Also, the mask processing illustrated in FIG. 8 is used. For the second replenishment amount R2*n*, when a V that is not zero is input, calculation is performed by the formula (15). When V is zero, the second replenishment amount R2*n* becomes zero.

$$R2n=g2\times V \quad (15)$$

<Explanation of Effect of Replenishment Control of Embodiment>

Figure 10A:
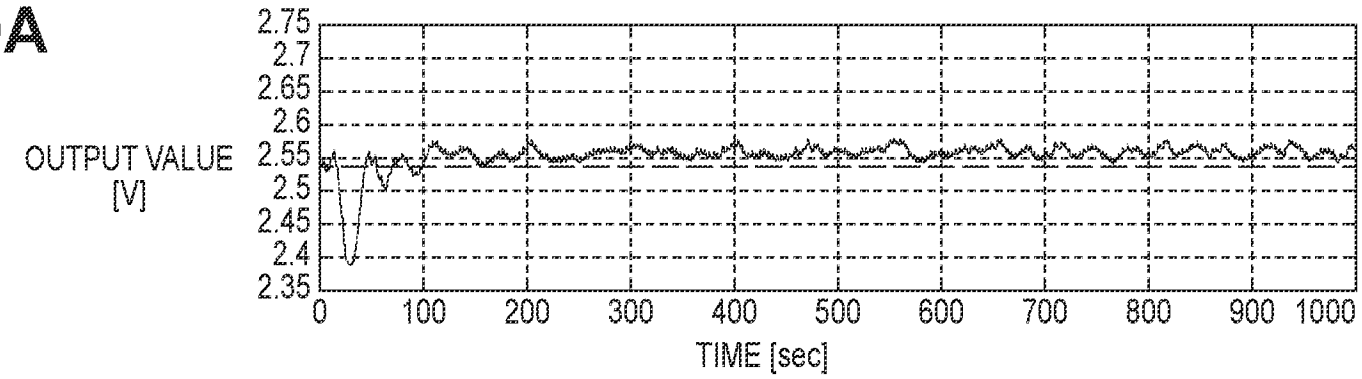
FIGS. 10A to 10D are views for explaining an effect of the embodiments.
Figure 10B:
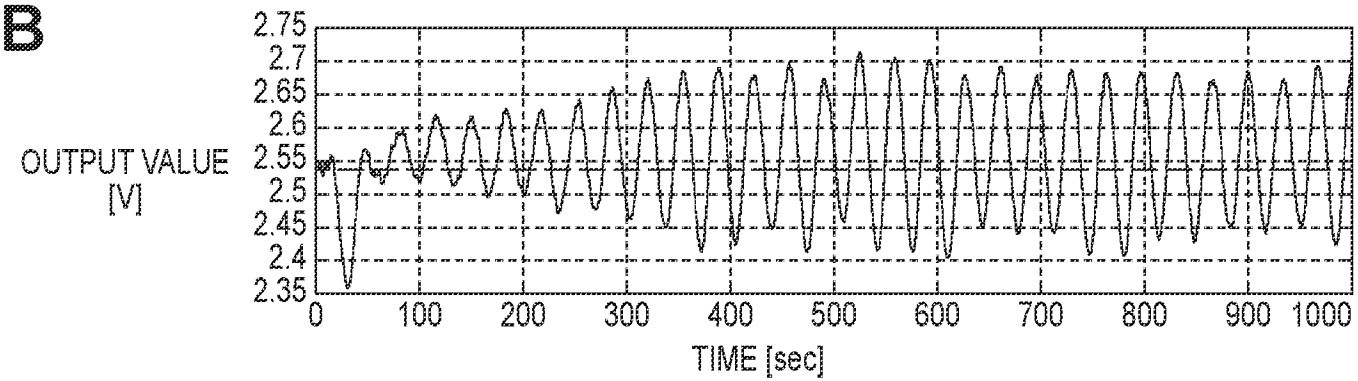
Figure 10C:
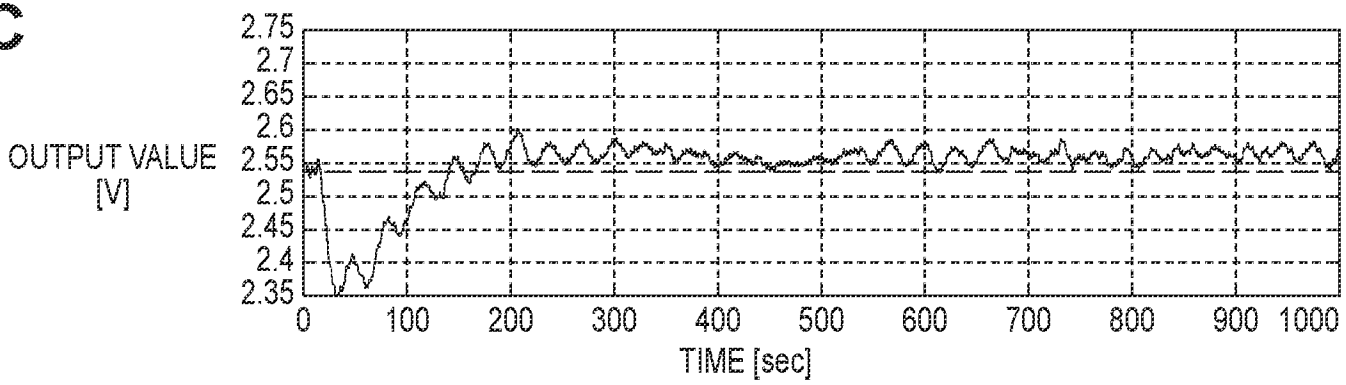

Explanation is given for an effect of the embodiment by comparing the embodiment with comparative example 1 and the comparative example 2. FIG. 10A illustrates output values of the toner density sensor in the embodiment. FIG. 10B illustrates output values of the toner density sensor of the comparative example 1. Note that equivalent feedback gains are set for the output values of the embodiment and the output values of comparative example 1 respectively. FIG. 10C illustrates an output value for when the gain of comparative example 1 caused to be lower than in the embodiment.

It can be seen by comparing FIG. 10A and FIG. 10B that the embodiment can reduce a plurality of ripples for which the periods differ sufficiently by the averaging processing and the filter. In other words, in the embodiment, the output values converge quickly to the target value. In comparative example 1, because a feedback gain that is equivalent to that of the embodiment is set, large ripples occur in the output values. This is because the toner cannot be mixed sufficiently due to the miniaturization of the developing unit 44. In other words, in comparative example 1, developer for which the toner density is not uniform in the detector unit of the toner density sensor pours in. Its influence is fed back for the toner replenishment amount, and control oscillation occurs. In order to prevent this oscillation, lowering of the feedback gain can be considered. However, when the feedback gain is lowered, the capability of the output value to return to the target value is lowered, as is illustrated in FIG. 10C. Accordingly, once the output values deviate from the target value due to an external disturbance, the state of deviation continues for a long time.

In contrast to this, in the embodiment, the fluctuation in the output values of the toner density sensor depending of the developer circulation period can be reduced by the bandstop filter 113. Also, the fluctuation in the output values of the toner density sensor in accordance with the mixing period can be reduced by the average unit 121. Accordingly, in the embodiment, the influence of fluctuation on the feedback control decreases, and good trackability with respect to the target value, and good convergence can be realized.

Figure 10D:
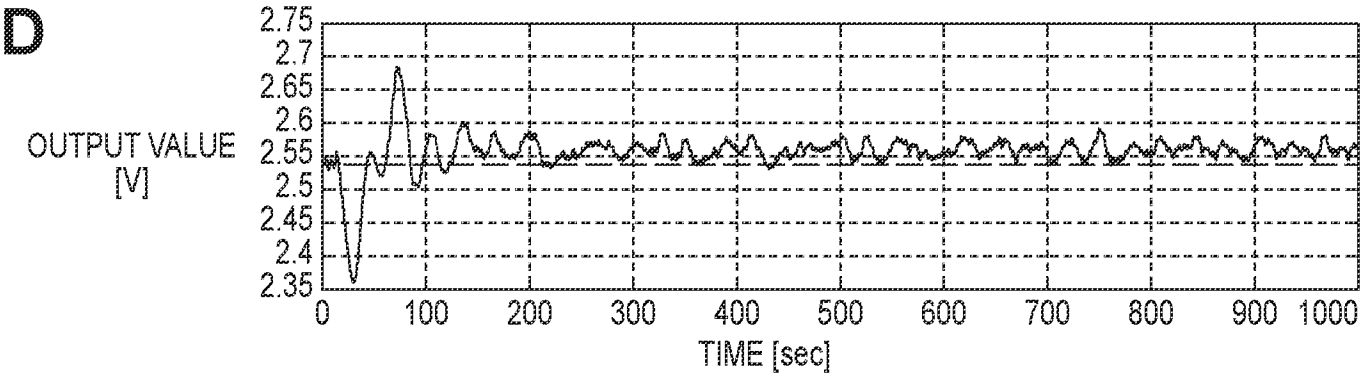
Figures 11A, 11B, 11C, 11D:
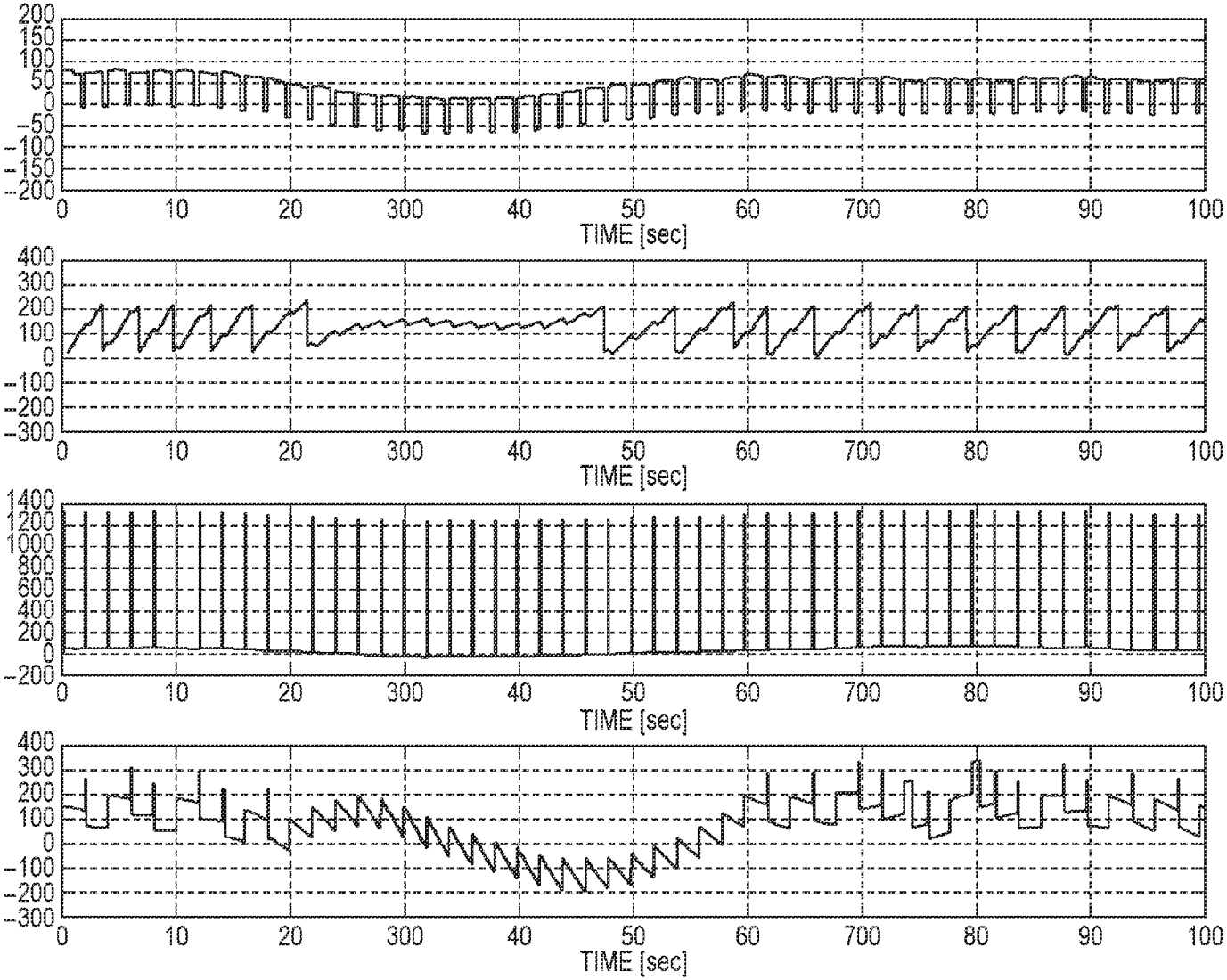
FIGS. 11A to 11D are views for explaining an effect of the embodiments.

FIG. 10D illustrates output values of the density sensor in comparative example 2. Comparing FIG. 10D and FIG. 10A, in FIG. 10D, in several places ripples of the waveform becomes large. FIG. 11A illustrates a summation value that the summation unit 117 of the embodiment outputs. FIG. 11B illustrates a replenishment buffer value in the arithmetic unit 118 of the embodiment. FIG. 11C illustrates a summation value that the summation unit 117 of the comparative example 2 outputs. FIG. 11D illustrates a replenishment buffer value in the arithmetic unit 118 of the comparative example 2.

In the comparative example 2, the calculation of the replenishment amount is executed in fine steps in synchronization with the operation of the screw as in the embodiment. For this reason, as FIG. 11C illustrates, there are cases where the video count value inputted discretely becomes a relatively large value. In other words, in the comparative example 2, there are cases of excessive replenishment amounts. This is the cause of the ripples illustrated in FIG. 10D.

In contrast to this, in the embodiment, the video count value is distributed with good balance and reflected in the replenishment amount as FIG. 11A illustrates. For this reason, in the embodiment, as FIG. 10A illustrates, the output values of the toner density sensor transition well.

<Conclusion>

In accordance with this embodiment, the replenishment controller 110 is provided with the bandstop filter 113 and the first determination unit 114. The bandstop filter 113 reduces a long period ripple that occurs in accordance with a circulation period of the developer 43 in accordance with the screws 58 and 59 in the toner density detected by the toner density sensor. The first determination unit 114 determines the first replenishment amount R1*n* based on the toner density for which the long period ripple is reduced by the bandstop filter 113. With this, it becomes possible to control at a high precision the replenishment of the developing unit 44 with toner. In particular, when attempting a reduction in capacity or a miniaturization of the developing unit 44, a long period ripple becomes noticeable. Accordingly, by reducing this long period ripple, replenishment of the developing unit 44 with toner is of a higher precision. In other words, a reduction in capacity and a miniaturization of the developing unit 44 and a precision improvement for replenishment can both be achieved where it was difficult to achieve both up until now.

As is explained using FIG. 4, the bandstop filter 113 is configured so as to execute a filter calculation at predetermined intervals during operation of the screws 58 and 59, for example. As is explained regarding step S214, or the like, the replenishment controller 110 comprises the storage unit 68 for storing a calculation variable used by the bandstop filter 113 when the screws 58 and 59 are stopped. As explained regarding step S202, step S204 or the like, the bandstop filter 113 is configured to execute a filter calculation using the calculation variables Pn and Qn read from the storage unit 68 when the screws 58 and 59 start operation. With this, a ripple is reduced precisely by continuing to use the calculation variables Pn and Qn of the previous time.

The replenishment controller 110 may further comprise the average unit 121 which masks the toner density output from the toner density sensor across a predetermined period from when the screws 58 and 59 start operation so that it is not reflected in the first replenishment amount R1*n*. As is explained regarding FIG. 7, even if the moving average D2 is obtained for the detected values D1 of the toner density sensor, the moving average D2 does not converge to an actual value in a predetermined period from when the screws 58 and 59 start operation. Accordingly, it becomes possible to further control replenishment of the developing unit 44 with toner at a higher precision by masking the moving average D2 for the detected values D1 for a predetermined period from when the screws 58 and 59 start operation.

Also, the average unit 121 may also function as a reduction unit for reducing a short period ripple that occurs in the toner density in accordance with a mixing period of the screws 58 and 59. As described above, the screws 58 and 59 are driven by a motor and rotate, conveying toner while mixing. Accordingly, a short period ripple occurs in accordance with the rotation period of the screws 58 and 59. Accordingly, by the average unit 121 reducing the short period ripple, replenishment of the developing unit 44 with toner is controllable with a higher precision.

As is explained regarding FIG. 8, the average unit 121 may also hold in the storage unit 68 a toner density (example: a detected value D1, the average value D3, or the like) for when the screws 58 and 59 are stopped. The average unit 121 may cause the toner density held in the storage unit 68 to be reflected in the first replenishment amount R1*n* in place of the masked toner density for the predetermined period when the screws 58 and 59 resume operation. In the bandstop filter 113, data for the toner density becomes necessary immediately when the screws 58 and 59 resume operation. However, the toner density is not provided in the masking interval. Accordingly, the storage unit 68 stores the toner density when the screws 58 and 59 are stopped, and the average unit 121 reads that out and uses it when the rotation of the screws 58 and 59 resumes. With this, when the screws 58 and 59 resume operation, the toner density (average value) can be supplied to the bandstop filter 113 immediately. Because the toner 63 is not replenished while the screws 58 and 59 are stopped, the toner density of the developer 43 does not change. Accordingly, even if the toner density for when replenishing the previous time is used as the toner density for when replenishing this time, a replenishment amount calculation precision is not degraded much.

The average unit 121 may also function as an average unit for obtaining an average value of the toner densities that the toner density sensor outputs. In such a case, the replenishment controller 110 controls the replenishment amount using the average value of the toner densities. The average unit 121 may obtain a moving average value of toner densities the toner density sensor outputs. Because not so many detected values of toner density are required to obtain the moving average value, the storage capacity for holding the detected values of toner density can be reduced. Additionally, the sample number used in calculating the moving average value (the number of detected values of toner density) is set to a number of an extent to which the short period ripple can be reduced.

As is explained using FIG. 3, the difference unit 111 may calculate the difference Xn between the toner density (average value) and a target density. In such a case, the bandstop filter 113 reduces the frequency component of a ripple in the frequency components included in the difference by applying a filter calculation to the difference Xn for toner density. Such a frequency passage characteristic of the bandstop filter 113 is a frequency passage characteristic for which the frequency component of the ripple is reduced as is illustrated in FIG. 5A. In this way, coefficients necessary for the filter calculation are determined depending on the frequency of the ripple.

As is explained using FIG. 3, by determining the replenishment amount considering not only the toner density but also the toner consumption amount obtained from the image signal, the toner replenishment amount is controlled stably. In such a case, the counter 66 counts the toner amount consumed in developing an electrostatic latent image based on the image signal. The second determination unit 116 determines the second replenishment amount R2*n* based on the count value of the counter 66. The summation unit 117 summates the first replenishment amount R1*n* that the first determination unit 114 determines and the second replenishment amount R2*n* that the second determination unit 116 determines. The CPU 67, the developing unit controller 120 and the toner replenishment basin 60 replenish the developing unit 44 with toner based on the summation value of the summation unit 117. With this, the toner replenishment amount can be controlled stably. Note that, the second determination unit 116 may determine the second replenishment amount R2*n* by dividing, into a plurality, the replenishment amount obtained by converting the count value. The toner consumption amount for 1 image is not ascertained until the count ends. When the toner consumption amount is reflected in the replenishment amount all at once, the replenishment amount is not stable as explained using FIG. 11C and FIG. 11D. This leads to an increase in ripples. Accordingly, by distributing the toner consumption amount for 1 image temporally, and causing it to be reflected in the replenishment amount, the replenishment amount is stable, as is explained using FIG. 11A, FIG. 11B or the like. In other words, a ripple in the toner density is reduced.

There are cases in which a ripple occurs in the developing unit 44, which is divided into the developing chamber and the mixing chamber. Accordingly, by applying the present embodiment, it becomes possible to control at a high precision replenishment of the developing unit 44 with toner.

<Other Embodiments>

A two-component developer is a developer including a toner and a carrier. An image forming apparatus develops an electrostatic latent image by causing a frictional electrification by mixing the toner and the carrier, and causing the toner to fly towards a photosensitive member. It is necessary for the toner to be replenished because it is consumed by developing. Also, in order to keep the density of the toner image at a desired density, it is necessary that a proportion between the toner and the carrier (a T/D ratio) to be maintained fixedly (Japanese Patent Laid-Open No. H9-127780).

Note that the T/D ratio in the developing unit can be detected by an optical sensor or an inductor sensor. However, because the output value of the sensor includes a component that fluctuates in accordance with the rotation period of the screws for mixing the toner in the developing unit, reduction of this fluctuation component is required. Accordingly, the present embodiment reduces the fluctuation component included in the detected value for the toner density in the developing unit.

This fluctuation component can be reduced by filtering such as that of a bandpass filter, for example. The bandpass filter in accordance with embodiments of the present specification is set by filter constants and filter variables such as a sensor output value of the previous time. The filter variables are updated in an interval in which toner is replenished such as an image formation interval. In the toner replenishment interval, the filter variables are updated because the T/D ratio fluctuates by toner being replenished and mixed. However, the sensor output value that is the source of the filter variables may change in an interval in which toner replenishment is not executed as well. For example, when the developing unit is exchanged, and when the image forming apparatus is activated when a power is supplied from an external power supply, it is necessary to mix the toner in the developing unit in order to reduce an uneven distribution of the developer, or to reduce a non-uniform charge of toner included in the developer. Accordingly, the filter variables being updated is required not only in a toner replenishment interval but also in intervals in which toner replenishment is not executed. Hypothetically, if the filter variables are not updated appropriately, there will be cases in which new noise will be added to the detected values due to the filtering. Accordingly, it is required that fluctuation of the T/D ratio be reduced by updating the filter variables when the screws in the developing unit rotate, irrespective of the existence/absence of toner replenishment. Accordingly, the present embodiment, by updating the filter variables appropriately, reduces a side effect of filtering and reduces fluctuation of detected values for toner density.

Figure 12:
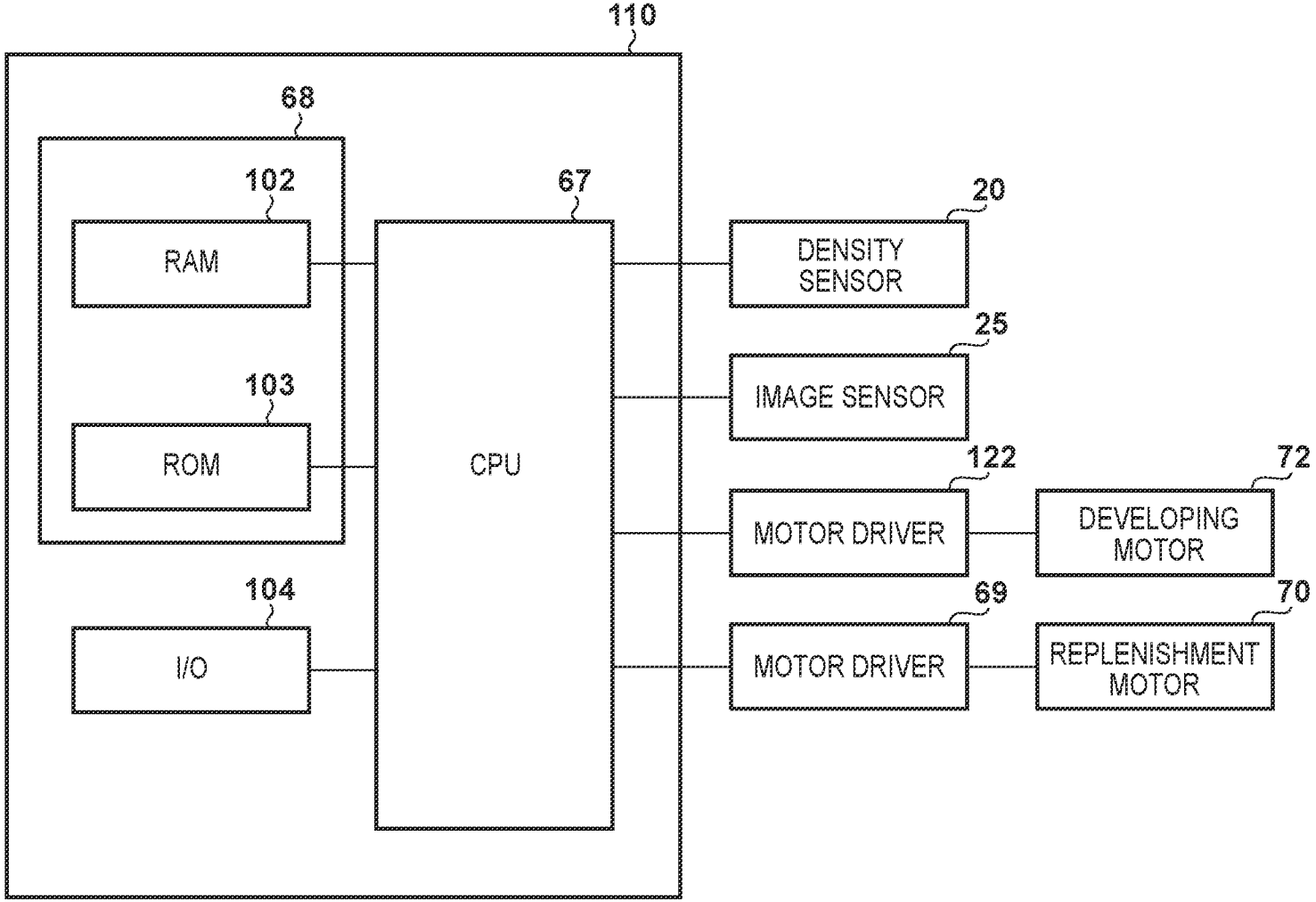
FIG. 12 is a block diagram for illustrating a control unit.

Using FIG. 12, the replenishment controller 110 is explained. The storage unit 68 (a RAM 102 and a ROM 103) and an I/O 104 are connected to the CPU 67. The CPU 67 executes control programs stored in the ROM 103 in accordance with signals input to the I/O 104. An even higher level controller for controlling the replenishment controller 110 is connected to the I/O 104. The CPU 67, in accordance with a control program, retrieves data such as an output value of the toner density sensor from the RAM 102, and drives the developing motor 72 and the replenishment motor 70 by controlling the motor driver 122 and the motor driver 69.

Figure 13A:
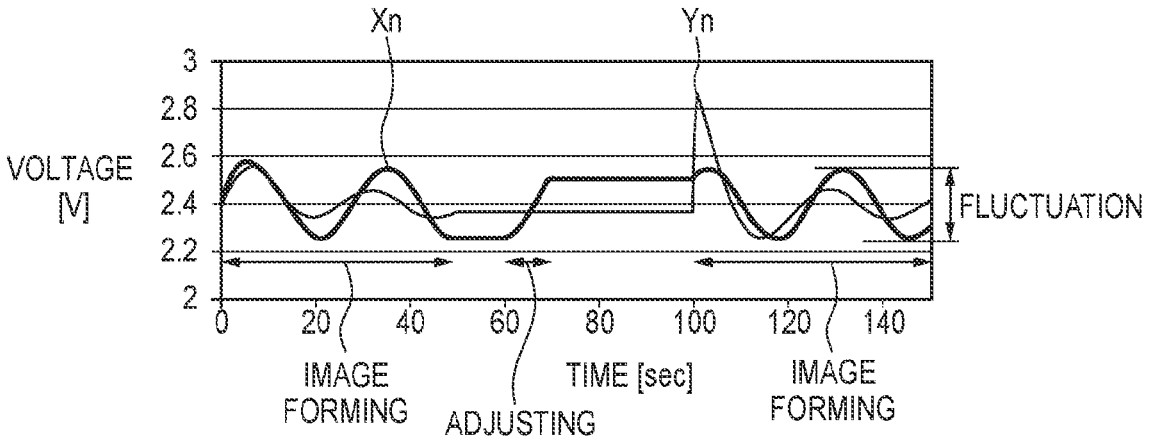
FIGS. 13A and 13B are views for illustrating detected values for toner density, and detected values where filtering is applied.

FIG. 13A is a view for illustrating a relationship between the inductance voltage Xn and the filter output Yn. Here, in an interval in which image formation is executed, toner replenishment is executed, and in this interval, a filter calculation is executed. An interval from 0 seconds to 50 seconds is an image formation interval. In this interval the toner replenishment is executed, and because mixing of toner by the screws 58 and 59 is executed, the inductance voltage Xn includes a fluctuation component of a fixed period. Meanwhile, for the filter output Yn, the fluctuation component is reduced compared to the inductance voltage Xn.

An interval from 50 seconds to 60 seconds is an interval in which image formation ends, replenishment of toner also is stopped, and mixing of the screws 58 and 59 is also stopped. Because in this interval toner is not mixed, the inductance voltage Xn does not change. Also, because the filter calculation is not executed in this interval, the filter output Yn is not updated.

An interval from 60 seconds to 70 seconds is an interval in which mixing is executed by the screws 58 and 59 for some reason. In this interval, toner is not replenished. Because toner is mixed, the inductance voltage Xn changes. However, because the filter calculation is not executed in this interval, the filter output Yn is not updated.

An interval from 70 seconds to 100 seconds is an interval in which replenishment of toner is not executed, replenishment of toner also is stopped, and mixing of the screws 58 and 59 is also stopped. Because in this interval toner is not mixed, the inductance voltage Xn does not change. Also, because the filter calculation is not executed in this interval, the filter output Yn is not updated.

In an interval from 100 seconds to 150 seconds, once again, image formation is executed. What should be paid attention to here is that the filter output Yn at the point in time of 100 seconds largely deviates from the actual inductance voltage Xn. This is because in order to calculate the filter output Yn, the filter variable $P_{n-1}$ that is used is something obtained at 50 seconds. Because the filter variable $P_{n-1}$ does not reflect the influence of mixing which is executed in the interval from 60 seconds to 70 seconds, the filter output Yn obtained using this filter variable largely deviates from the actual inductance voltage Xn.

As is clear from FIG. 13A, the filter variables should be updated not only in the toner replenishment interval (the image formation interval) but also in an interval in which the inductance voltage Xn may fluctuate. In other words, by the CPU 67 updating the filter variables in an interval in which the inductance voltage Xn may fluctuate, the precision of the filter output Yn is improved. Rotation of the screws 58 and 59, for example, is a cause of fluctuation of the inductance voltage Xn. The CPU 67 causes the screws 58 and 59 to rotate when the developing unit 44 is exchanged, when the image forming apparatus activates, and when a non-uniform charge of toner is predicted. Accordingly, the CPU 67 updates the filter variables even at these times in addition to in image formation intervals. For example, the CPU 67 updates filter variables when an event that the detected value for toner density may fluctuate (for example, an event for which the screws 58 and 59 rotate) is detected.

<Flowchart>

Figure 14:
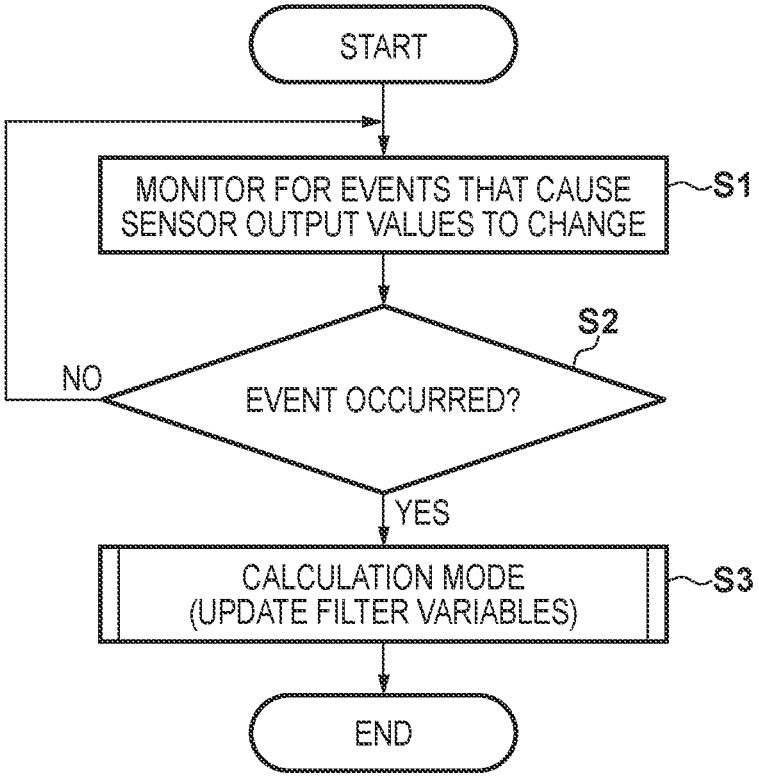
FIG. 14 is a flowchart for illustrating processing for updating filter variables.

Using FIG. 14, filter variable update processing is explained. In step S1, the CPU 67 monitors various events that occur for the image forming apparatus in order to detect the occurrence of an event that causes the output value Xn of the toner density sensor 20 to change. One such event is an event where the screws 58 and 59 are caused to rotate. For example, a non-uniform charge in the toner being predicted upon the exchange of the developing unit 44, the activation of the image forming apparatus, or the end of image formation, and an interval being open for a predetermined amount of time or greater from the job of the previous time are examples of events. For such events, in order to stabilize a state of the developer prior to performing image formation, processing for causing the screws 58 and 59 to rotate idly without performing toner replenishment is included. Idle rotation is causing the screws 58 and 59 to rotate without replenishing toner. An exchange of the developing unit 44 may be monitored based on the result of the detection by a sensor that detects attachment/removal of the developing unit 44, or may be monitored based on an input value (an input value indicating an exchange of the developing unit 44) input from the operation unit to the CPU 67. The CPU 67 executes authentication processing for the developing unit 44 (obtainment and comparison of unique identification information), and detects that the developing unit 44 is exchanged. A non-uniform charge of toner may occur when forming a plurality images consecutively where toner is consumed in a large amount, for example. Accordingly, the CPU 67 may predict a toner non-uniform charge occurrence from the toner consumption amount obtained from the image signal. Note that the common point of these events is that the screws 58 and 59 are caused to rotate. Accordingly, image formation is also an example of an event where the output value Xn is caused to change. For example, the CPU 67 forming a toner patch on the transfer material 48 or the intermediate transfer belt (the carry belt 47), and adjusting the target value of the output value Xn based on the image density of the toner patch is also an example of an event.

In step S2, the CPU 67 determines whether or not a predetermined event occurs based on the result of monitoring for events. If a predetermined event does not occur, the CPU 67 returns to step S1. On the other hand, if a predetermined event does occur, the CPU 67 proceeds to step S3.

In step S3, the CPU 67 executes a calculation mode. The calculation mode is processing including obtaining the output value Xn, reading the filter variables $P_{n-1}$ and $Q_{n-1}$, determining the filter variables Pn and Qn, and determining the filter output Yn. For the filter variables Pn and Qn and the filter output Yn, execution is in accordance with, for example, Equation (1) through Equation (3).

In this way, when an event where the output value Xn of the toner density sensor is caused to change is detected, the filter variables Pn and Qn are updated, and therefore the filter output Yn is obtained precisely.

Figure 15:
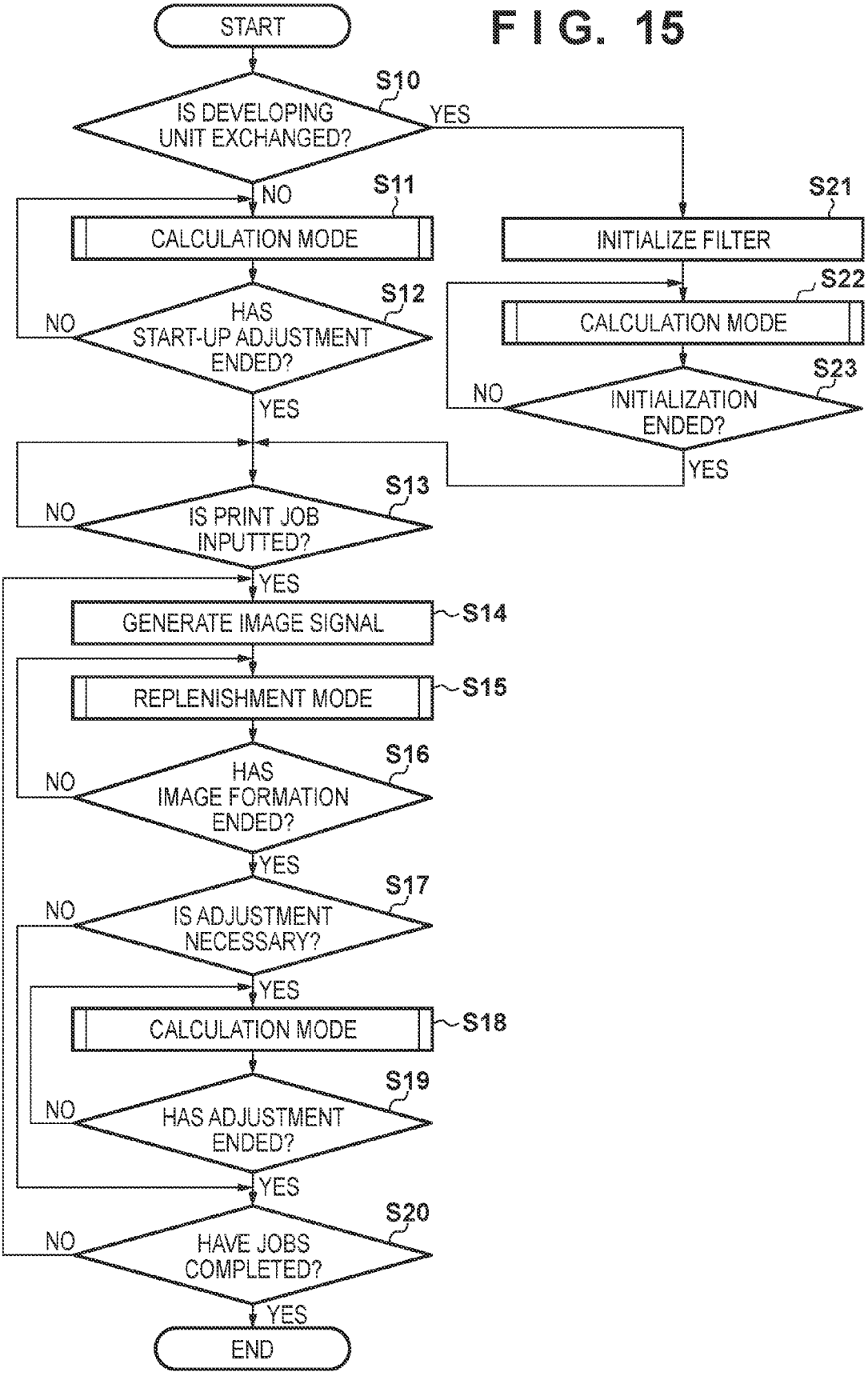
FIG. 15 is a flowchart for illustrating processing for updating filter variables.

Using FIG. 15, control processing for toner density accompanying processing for updating filter variables is explained. A control program for executing this flowchart and filter constants are stored in the ROM 103, and filter variables are stored in the RAM 102. When the power is supplied from an external power supply to the image forming apparatus and it activates, the CPU 67 executes the following processing.

In step S10, the CPU 67 determines whether or not the developing unit 44 is exchanged. The exchange of the developing unit 44 may be determined based on a result of a detection of a sensor for detecting attachment/removal of the developing unit 44, or may be determined based on an input value input through an operation unit connected to the CPU 67. If the developing unit 44 is not exchanged, the CPU 67 proceeds to step S11.

In step S11, the CPU 67 starts a calculation mode. The calculation mode is explained later in detail. In step S12, the CPU 67 determines whether or not a start-up adjustment prior to starting a print job ends. In the start-up adjustment, processing for causing the screws 58 and 59 to rotate so that, for example, the filter output Yn becomes sufficiently near to the target value Yt is included. Accordingly, the CPU 67 may determine that the start-up adjustment of the developing unit 44 ends when a difference ΔY between the filter output Yn and the target value Yt becomes smaller than a threshold value. If the start-up adjustment has not ended, the CPU 67 returns to step S11, and repeats execution of the calculation mode. The execution cycle of step S11 in the loop consisting of step S11 and step S12 is, for example, 0.1 [seconds]. When the start-up adjustment of the developing unit 44 ends, the CPU 67 proceeds to step S13.

In step S13, the CPU 67 determines whether or not a print job is inputted. A print job is inputted from an operation unit or a host computer to the CPU 67. If a print job is inputted, the CPU 67 proceeds to step S14.

In step S14, the CPU 67 generates an image signal using the image processing circuit 34. The image signal is generated for every image. In step S15, the CPU 67 executes a replenishment mode. The replenishment mode is explained later in detail. In this way, the replenishment mode is processing for replenishing toner during image formation.

In step S16, the CPU 67 determines whether or not image formation ended. If image formation has not ended, the CPU 67 returns to step S15, and executes the replenishment mode. If image formation has ended, the CPU 67 proceeds to step S17.

In step S17, the CPU 67 determines whether or not adjustment processing for causing the screws 58 and 59 to rotate is necessary. Various adjustment processing exists in the image forming apparatus. For example, when adjusting an amount of electrical charge of the photosensitive drum 40, toner is not used, and therefore it is not necessary to cause the screws 58 and 59 to rotate. Meanwhile, it is necessary to cause the screws 58 and 59 to rotate when forming a toner patch on the intermediate transfer belt or the transfer material 48 in order to adjust an image formation position or a tone characteristic. Note that the CPU 67 may determine whether or not the adjustment of the amount of electrical charge is necessary based on the electrical current flowing to the primary charger 42. Also, the CPU 67 may determine whether or not an adjustment of an image formation position or a tone characteristic is necessary based on the number of image forming materials. If adjustment processing for causing the screws 58 and 59 to rotate is not necessary, the CPU 67 proceeds to step S20. If adjustment processing for causing the screws 58 and 59 to rotate is necessary, the CPU 67 proceeds to step S18. In step S18, the CPU 67 executes a calculation mode.

In step S19, the CPU 67 determines whether or not adjustment processing accompanying the rotation of the screws 58 and 59 has ended. For example, in adjustment processing of the image formation position (a color misregistration correction, or the like), when reading of a toner patch completes, the CPU 67 determines that adjustment ended. If adjustment has not ended, the CPU 67 returns to step S18, and executes the calculation mode. If adjustment has ended, the CPU 67 proceeds to step S20.

In step S20, the CPU 67 determines based on the print job whether or not all jobs ended. For example, if there is a print job for printing 10 images continuously, the CPU 67 determines that all jobs ended when printing of all 10 images completes. If all jobs have ended, the CPU 67 ends the processing corresponding to this flowchart, and if all jobs have not ended, the CPU 67 returns to step S14, and generates an image signal for the next image.

Note that if the developing unit is exchanged, the CPU 67 proceeds to step S21 from step S10. In step S21, the CPU 67 initializes a bandpass filter. For example, the CPU 67 sets initial values for the filter variables Pn and Qn. The initial values are values (for example, zero) determined in advance at the time of shipment from the factory.

In step S22, the CPU 67 executes a calculation mode. The calculation mode of step S22 is basically the same as the calculation mode of step S3, step S11, and step S18. In step S23, the CPU 67 determines whether or not initialization of the developing unit 44 which is new has ended. The developing unit 44, which is manufactured in a factory, is transported in accordance with a distribution route. At that time, there are cases in which the developing unit 44 vibrates. As a counter-measure to vibration accompanying transporting, the developer 43 is installed so that there is an uneven distribution of the developer 43 where there is more in the second chamber 53 than in the first chamber 52. For this reason, it is necessary to cause the screws 58 and 59 to rotate for a fixed interval in order to reduce the uneven distribution of the developer 43 when installing the developing unit 44 in the image forming apparatus. This is initialization. If initialization has not ended, the CPU 67 returns to step S22. If initialization has ended, the CPU 67 proceeds to step S13. Whether or not the developing unit 44 initialization has ended can be determined based on whether or not, for example, a fixed interval has elapsed.

<Calculation Mode>

Figure 16:
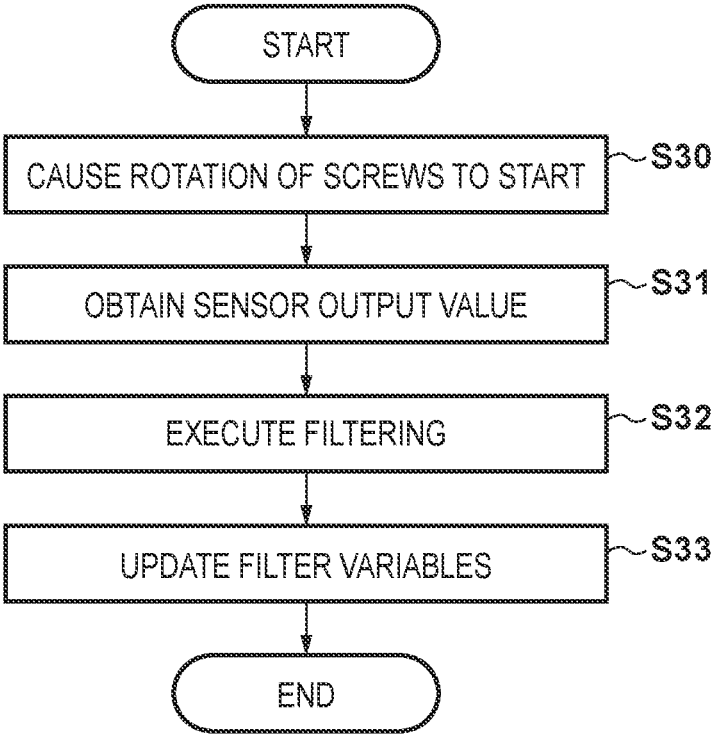
FIG. 16 is a flowchart for illustrating a filter variable calculation mode.

Using FIG. 16, the calculation mode is explained in detail. In step S30, the CPU 67 starts rotation of the screws 58 and 59. The CPU 67 causes the screws 58 and 59 to rotate by controlling the developing motor 72 through the motor driver 122.

In step S31, the CPU 67 obtains the output value Xn that the toner density sensor outputs. The output value Xn is a voltage that is correlated (inversely-proportional) with the T/D ratio and may be referred to as an inductance voltage.

In step S32, the CPU 67 executes filtering of the output value Xn. For example, the CPU 67 reads a filter constant b0 from the ROM 103, and reads the filter variable $P_{n-1}$ of the previous time from the RAM 102. Furthermore, the CPU 67 substitutes the output value Xn of this time, the filter constant b0, and the filter variable $P_{n-1}$ of the previous time into Equation (1), and calculates the filter output Yn of this time.

In step S33, the CPU 67 updates the filter variables Pn and Qn. The CPU 67 reads the filter constants b1 and a1 from the ROM 103, and reads the filter variable $Q_{n-1}$ of the previous time from the RAM 102. Furthermore, the CPU 67 substitutes the output value Xn of this time, the filter output Yn of this time, and the filter constants b1 and a1 and the filter variable $Q_{n-1}$ of the previous time into Equation (2) to calculate the filter variable Pn of this time. Furthermore, the CPU 67 reads the filter constants b2 and a2 from the ROM 103. Furthermore, the CPU 67 substitutes the output value Xn of this time, the filter output Yn of this time, and the filter constants b2 and a2 into Equation (3) to calculate the filter variable Qn of this time. The CPU 67 stores the filter variables Pn and Qn in the RAM 102.

<Replenishment Mode>

Figure 17:
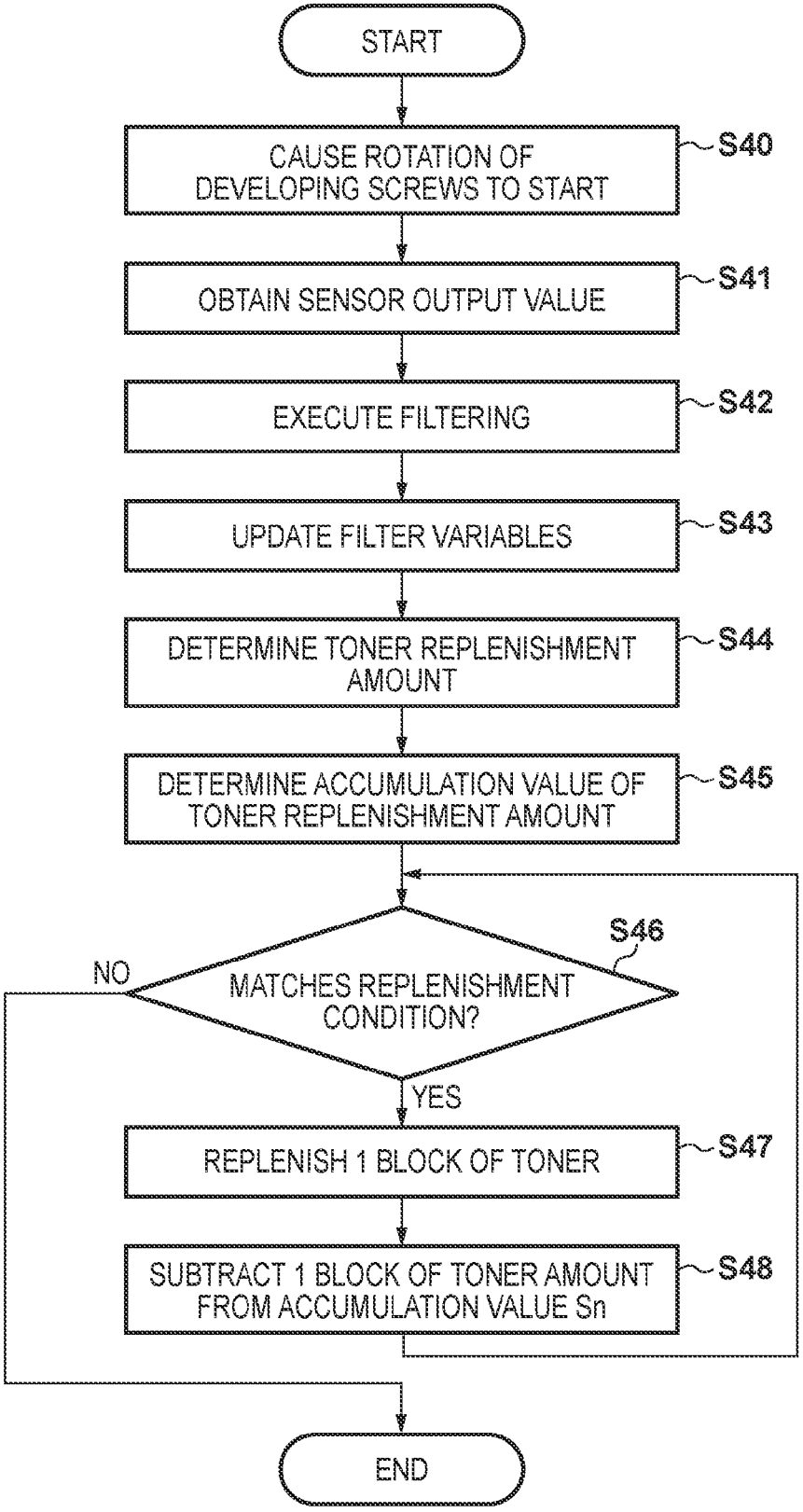
FIG. 17 is a flowchart for illustrating a replenishment mode.

Using FIG. 17, the replenishment mode is explained in detail. In step S40, the CPU 67 starts rotation of the screws 58 and 59. The CPU 67 causes the screws 58 and 59 to rotate by controlling the developing motor 72 through the motor driver 122.

In step S41, the CPU 67 obtains the output value Xn that the toner density sensor outputs. The output value Xn is a voltage that is correlated (inversely-proportional) with the T/D ratio and may be referred to as an inductance voltage.

In step S42, the CPU 67 executes filtering of the output value Xn. For example, the CPU 67 reads the filter constant b0 from the ROM 103, and reads the filter variable $P_{n-1}$ of the previous time from the RAM 102. Furthermore, the CPU 67 substitutes the output value Xn of this time, the filter constant b0, and the filter variable $P_{n-1}$ of the previous time into Equation (1) to calculate the filter output Yn of this time.

In step S43, the CPU 67 updates the filter variables Pn and Qn. The CPU 67 reads the filter constants b1 and a1 from the ROM 103, and reads the filter variable $Q_{n-1}$ of the previous time from the RAM 102. Furthermore, the CPU 67 substitutes the output value Xn of this time, the filter output Yn of this time, and the filter constants b1 and a1 and the filter variable $Q_{n-1}$ of the previous time into Equation (2), and calculates the filter variable Pn of this time. Furthermore, the CPU 67 reads the filter constants b2 and a2 from the ROM 103. Furthermore, the CPU 67 substitutes the output value Xn of this time, the filter output Yn of this time, and the filter constants b2 and a2 into Equation (3) to calculate the filter variable Qn of this time. The CPU 67 stores the filter variables Pn and Qn in the RAM 102.

In step S44, the CPU 67 determines the toner supply amount Rn based on the filter output Yn. For example, the CPU 67 obtains the difference ΔY between the filter output Yn and the target value Yt. This difference will be referred to an inductance difference. Furthermore, the CPU 67 determines the toner supply amount Rn from the inductance difference ΔY using the PID control. For example, the CPU 67 adds something that multiplies a P gain with the inductance difference ΔY, something that integrates the inductance difference ΔY and further multiplies an I gain, and something that differentiates the inductance difference ΔY and further multiplies a D gain. This sum is the toner supply amount Rn. Setting the D gain to 0, and only controlling PI (PI control), and setting the I gain and the D gain to 0 and only controlling P (P control) is encompassed in PID (Proportional-Integral-Derivative) control. Note that PID gains such as the P gain, the D gain and the I gain are determined such that stability and controllability will be good by performing experimentation and simulations at the time of designing the image forming apparatus in advance, and are stored in the ROM 103. The CPU 67 calculates a toner replenishment amount by reading these parameters from the ROM 103.

In step S45, the CPU 67 obtains the accumulation value Sn of the toner replenishment amount. The CPU 67 functions as an accumulation unit. For example, the CPU 67 retrieves the accumulation value $S_{n-1}$ for the replenishment amount obtained by the toner replenishment of the previous time saved in the RAM 102. The CPU 67 obtains the accumulation value Sn of this time by adding the toner supply amount Rn of this time to the retrieved accumulation value $S_{n-1}$, and overwrites it in the RAM 102. For example, an accumulation value $S_{n-1}$ of toner replenishment amount obtained by toner replenishment from a first time to an n-1th time is the accumulation value of the previous time. Note that when a toner replenishment is executed, the amount of toner replenished is decremented from the accumulation value. An accumulation value Sn of this time (in other words, an nth time) is obtained by adding the toner supply amount Rn of this time obtained in step S12 to the accumulation value $S_{n-1}$ of the previous time. Additionally, the accumulation value Sn indicates a deficiency amount for toner in the developing unit 44.

In step S46, the CPU 67 determines whether or not a replenishment condition is satisfied. The CPU 67 functions as a determination unit. The replenishment condition may be that, for example, the accumulation value Sn exceeds a minimum replenishment amount Rmin set in advance. The minimum replenishment amount Rmin is set at a design stage of the image forming apparatus in advance in order to reduce frequent toner replenishment. Note that the minimum replenishment amount Rmin is greater than the toner amount (the block toner amount Rb) replenished by driving the replenishment motor 70 one time. The block toner amount Rb is a minimum unit of toner replenishment amount. Note that replenishment of toner for each toner block is referred to as block replenishment. If the accumulation value Sn does not exceed the minimum replenishment amount Rmin, the replenishment condition is not satisfied, and therefore the CPU 67 ends the processing corresponding to this flowchart. On the other hand, if the accumulation value Sn exceeds the minimum replenishment amount Rmin, the replenishment condition is satisfied, and therefore the CPU 67 proceeds to step S47.

In step S47, the CPU 67 causes the replenishment motor 70 to rotate by controlling the motor driver 69, and thereby replenishes the developing unit 44 with 1 block of toner. The CPU 67 functions as a motor control unit. In step S48, the CPU 67 subtracts the block toner amount Rb from the accumulation value Sn. The CPU 67 functions as a subtracting unit. After that, the CPU 67 returns to step S46. In other words, while the replenishment condition is satisfied, toner is replenished by the block toner amount Rb.

Figure 13B:
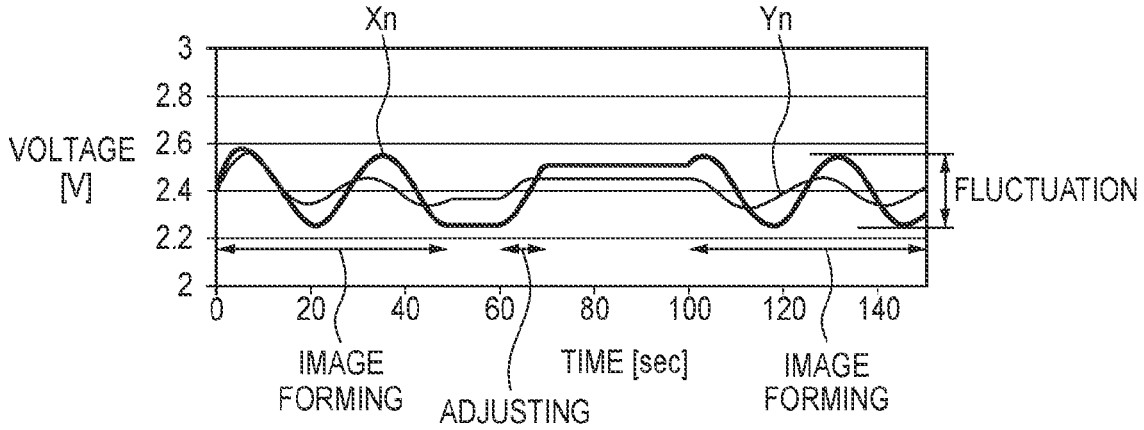

FIG. 13B illustrates the output value Xn and the filter output Yn of the toner density sensor to which the present embodiment is applied. The filter output Yn in the comparative example updates the filter variables only in the replenishment mode, and as is illustrated in FIG. 13A, a new fluctuation component occurs due to filtering in the proximity of 100 [seconds]. This fluctuation component occurs due to the filter variables not being updated in spite of the fact that the screws 58 and 59 rotate in an interval in which image formation is not executed. Meanwhile, in the present embodiment, as FIG. 13B illustrates, this kind of fluctuation component is reduced. In the present embodiment, the filter variables are updated if the screws 58 and 59 rotate even in an interval in which the image formation is not executed. With this, the fluctuation component is reduced. Also, due to the effect of filtering, the fluctuation component of the output value Xn accompanying the rotation period of the screws 58 and 59 is also reduced.

In this way, when an event for which there is a fear that the toner density will be caused to change, such as an event where the screws 58 and 59 rotate, is detected, the CPU 67 updates the filter variables. This means that the filter variables obtained by the replenishment mode and the filter variables obtained by the calculation mode are common, and the continuity of the filter variables is maintained.

Figure 18:
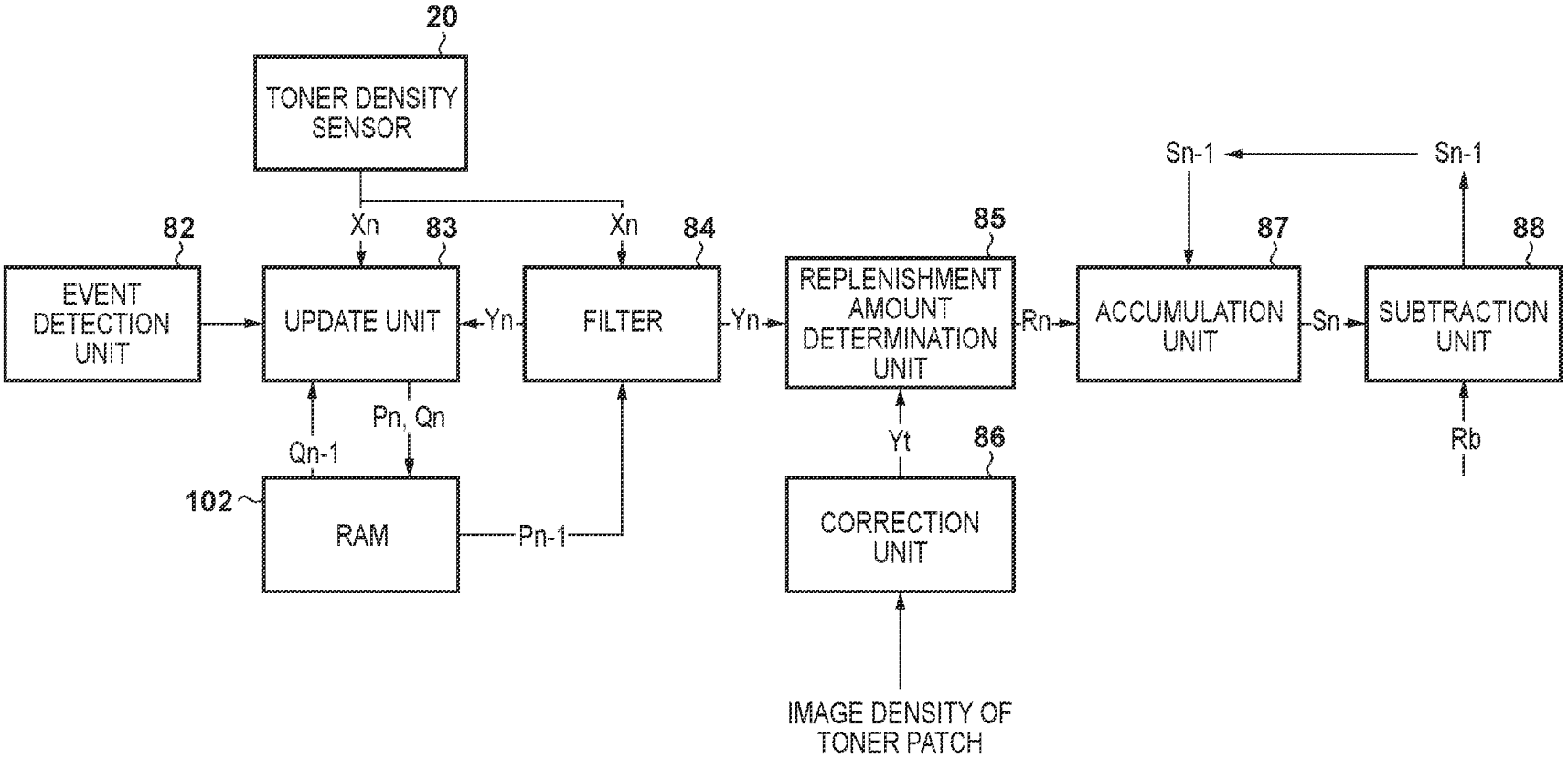
FIG. 18 is a view for illustrating functions realized by a CPU.

FIG. 18 illustrates an example of functions realized by the CPU 67 executing a control program. All or a portion of these functions may be realized by a logic circuit. A filter 84 is a bandpass filter that reduces a fluctuation component included in the output value Xn, which is a toner density detected by the toner density sensor 20, and outputs the filter output Yn. A fluctuation component is a component that fluctuates in accordance with the mixing period of the screws 58 and 59, for example. The filter 84, based on the filter constant b0 held in the ROM 103 and $P_{n-1}$ held in the RAM 102, determines the filter output Yn by filtering the output value Xn in the calculation, and outputs it to a replenishment amount determination unit 85. An event detector unit 82 detects an event for which there is the possibility that the toner density of the developer 43 stored in the developing unit 44 will be caused to change. When the event detector unit 82 detects an event, an update unit 83 updates the filter variables Pn and Qn that determine a filtering characteristic of the filter 84, and stores them in the RAM 102. For example, the update unit 83 updates the filter variables Pn and Qn using the filter constants a1, a2, b1 and b2, which are held in the ROM 103, and $Q_{n-1}$, the output value Xn and the filter output Yn which are held in the RAM 102. As is explained using FIG. 13A and FIG. 13B, by virtue of this embodiment, it becomes possible to reduce the fluctuation component included in the output value Xn which is a detected value for toner density in the developing unit 44 by filtering of the filter 84. As explained using FIG. 13B, by virtue of this embodiment, fluctuation of detected values for toner density is reduced because the update unit 83 updates the filter variables when an event where the detected values for toner density are caused to change occurs.

An event that is the trigger for updating the filter variables is an event where the screws 58 and 59 are caused to operate. This is because when the screws 58 and 59 execute a mixing operation, the output value Xn fluctuates independently of the existence/absence replenishment of toner.

There are various such events. For example, as explained in relation to step S15, forming a toner image with toner contained in the developer 43 is an example of an event. As explained in relation to step S10, the developing unit 44 being exchanged is also an example of an event. As explained in relation to step S18, adjusting control parameters (the image formation position (exposure timing)) of the image forming apparatus while causing the screws 58 and 59 to operate is also an example of an event. Also, as is explained in relation to step S11, activating the image forming apparatus, and the time over which an image is not formed in the image forming apparatus exceeding a threshold time are also examples of events. This is because through toner is not replenished in these events, the screws 58 and 59 rotate. When the time over which an image is not formed exceeds the threshold time, the carrier that is charged in the developer 43 decreases, and air contained in the developer 43 decreases. Accordingly, the screws 58 and 59 mix the developer 43 so that the toner charge amount and the air amount become suitable for forming a toner image.

Further explanation is given for events. A correction unit 86 is connected to the image sensor 25 for reading a toner patch formed by the developing unit 44. The correction unit 86 corrects the target density (the target value Yt) of the toner density (the filter output Yn) of the developer 43 stored in the developing unit 44 based on the image density of the toner patch read by the image sensor 25. In this way, even when correcting the target value Yt by forming the toner patch, the filter variables are updated because the screws 58 and 59 of the developing unit 44 execute a mixing operation. In other words, forming a toner patch by toner of the developer 43 is an example of an event. Additionally, in the present embodiment, an optical density in a toner image is referred to as an image density and a T/D ratio is referred to as the toner density of the developer 43.

As is explained using FIG. 15, the CPU 67 comprises a replenishment mode which is a first mode for updating the filter variables Pn and Qn while replenishing the developing unit 44 with toner in an interval in which the toner image is formed. Furthermore, the CPU 67 comprises a calculation mode which is a second mode for updating the filter variables Pn and Qn without replenishing the developing unit 44 with toner in an interval when a toner image is not being formed. As explained using FIG. 13A, there are cases where a side effect of filtering occurs when using only the replenishment mode. Accordingly, as explained using FIG. 13B, the side effect of filtering can be reduced by introducing the calculation mode.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-002595, filed Jan. 8, 2015 and Japanese Patent Application No. 2015-007190, filed Jan. 16, 2015 which are hereby incorporated by reference wherein in their entirety.

What is claimed is:

1. An image forming apparatus, comprising:

a latent image forming unit configured to form an electrostatic latent image on an image carrier based on an image signal;

a development unit that includes a circulation mechanism configured to circulate developer along a circulation course in the development unit, and that is configured to develop the electrostatic latent image using the developer;

a sensor configured to detect a toner density of the developer in the development unit and output a detected value corresponding to the detected toner density;

a determination unit configured to determine a replenishment amount of toner to the development unit based on the detected value output by the sensor; and a replenisher unit configured to replenish the development unit with toner based on the replenishment amount determined by the determination unit, wherein the determination unit reduces a long period ripple of the detected value that occurs in accordance with a period of circulation of the developer along the circulation course by executing filter processing for reducing the long period ripple.

2. The image forming apparatus according to claim 1, wherein the determination unit includes a filter unit configured to execute the filter processing, and wherein the filter unit is further configured to execute filter processing at a predetermined interval during operation of the circulation mechanism.

3. The image forming apparatus according to claim 2, wherein the determination unit includes a storage unit configured to store a calculation variable used by the filter unit when the circulation mechanism is stopped, and wherein the filter unit is further configured to execute the filter processing using a calculation variable read from the storage unit when the circulation mechanism starts an operation.

4. The image forming apparatus according to claim 3, wherein the determination unit includes a first determination unit configured to determine a first replenishment amount in the replenishment amount based on the detected value for which the long period ripple is reduced by the filter unit.

5. The image forming apparatus according to claim 4, further comprising a mask unit configured to cause the detected value to not be reflected in the first replenishment amount by masking the detected value output from the sensor during a predetermined period from when the operation of the circulation mechanism starts.

6. The image forming apparatus according to claim 5, wherein the mask unit is further configured to hold the detected value when the circulation mechanism is stopped, and configured to reflect the held detected value in the first replenishment amount in place of the masked detected value in the predetermined period after the circulation mechanism resumes operation.

7. The image forming apparatus according to claim 1, further comprising a difference unit configured to calculate a difference between the detected value and a target value corresponding to a target density, wherein the determination unit reduces the long period ripple which is included in the difference by applying the filter processing to the difference for the toner density.

8. The image forming apparatus according to claim 1, wherein the development unit comprises:

a first chamber including a conveyer unit configured to convey the developer to the image carrier; and a second chamber that communicates with the first chamber, and to which toner is supplied from the replenisher unit, and wherein the circulation mechanism comprises:

a first circulator that is arranged in the first chamber, and that is configured to mix developer existing in the first chamber, and to cause the developer to circulate between the first chamber and the second chamber; and a second circulator that is arranged in the second chamber, and that is configured to mix developer that exists in the second chamber and toner supplied by the replenisher unit, and to cause the developer to circulate between the first chamber and the second chamber.

9. The image forming apparatus according to claim 1, wherein a time period of mixing the developer by the circulation mechanism is shorter than a time period of circulating the developer along the circulation course by the circulation mechanism, the determination unit includes a reduction unit configured to reduce a short period ripple of the detected value due to a rotation period of the circulation mechanism, and a time period of the short period ripple is shorter than a time period of the long period ripple.

10. The image forming apparatus according to claim 9, wherein the reduction unit includes an average unit configured to obtain an average value of detected values that the sensor outputs, and wherein the determination unit determines the replenishment amount using an average value of the toner densities.

11. The image forming apparatus according to claim 10, wherein the average unit is further configured to obtain a moving average value of detected values that the sensor outputs.

12. The image forming apparatus according to claim 4, further comprising:

a counter configured to count a toner amount consumed to develop the electrostatic latent image based on the image signal;

a second determination unit configured to determine a second replenishment amount based on a count value of the counter; and a summation unit configured to summate the first replenishment amount that the first determination unit determines and the second replenishment amount that the second determination unit determines, wherein the replenisher unit replenishes the development unit with the toner based on a summation value of the summation unit.

13. The image forming apparatus according to claim 12, the second determination unit determines the second replenishment amount by dividing, into a plurality, a replenishment amount obtained by converting the count value.

* * * * *